United States Patent [19]

Burg et al.

[11] Patent Number: 4,970,964

[45] Date of Patent: Nov. 20, 1990

[54] SINGLE TURNOUT ROTARY GUIDEWAY SWITCH AND A DUAL LANE CROSSOVER STATION EMPLOYING THE SAME

[75] Inventors: Thomas J. Burg, Forest Hills; Ronald H. Ziegler, Elizabeth; William K. Cooper, Monroeville; John W. Kapala; Robert J. Anderson, both of McMurray, all of Pa.

[73] Assignee: AEG Westinghouse Transportation Systems, Inc., Pittsburgh, Pa.

[21] Appl. No.: 211,610

[22] Filed: Jun. 27, 1988

[51] Int. Cl.[5] ..... E01B 25/06

[52] U.S. Cl. ..... 104/130; 246/258; 246/415 R; 246/419; 246/431; 246/448

[58] Field of Search ..... 246/257, 258, 415 R, 246/419, 431, 448; 104/101, 130, 247; 191/29 R

[56] References Cited

U.S. PATENT DOCUMENTS

| | | | |
|---|---|---|---|
| 557,338 | 3/1896 | Osborne | 246/431 |
| 557,339 | 3/1896 | Osborne | 246/431 |
| 569,034 | 10/1896 | Sturgis et al. | 246/431 |
| 1,516,513 | 11/1924 | Taffe | 246/431 |
| 1,833,679 | 11/1931 | Jefferson et al. | 246/257 |
| 3,113,529 | 12/1963 | Maestrelli | 246/431 X |
| 3,308,766 | 3/1967 | Urbinati | 246/431 X |
| 3,640,227 | 2/1972 | Webb | 104/130 |
| 3,774,544 | 11/1973 | Mouillon | 104/130 |
| 3,782,291 | 1/1974 | Maison | 104/101 X |
| 3,835,785 | 9/1974 | Kirschner et al. | 104/130 |
| 3,972,293 | 8/1976 | Watts | 104/130 |
| 4,090,452 | 5/1978 | Segar | 104/130 X |
| 4,109,584 | 8/1978 | Mihirogi | 104/130 |
| 4,132,175 | 1/1979 | Miller et al. | 104/130 |
| 4,215,837 | 8/1980 | Vozumi et al. | 246/433 |
| 4,428,552 | 1/1984 | Frank et al. | 246/258 X |
| 4,453,051 | 6/1984 | Brown | 191/29 R X |

FOREIGN PATENT DOCUMENTS

| | | | |
|---|---|---|---|
| 0010715 | of 1895 | United Kingdom | 246/448 |
| 1474851 | 3/1967 | France . | |
| 0589233 | 3/1959 | Italy | 104/130 |

OTHER PUBLICATIONS

"C45 Vehicle System Development Program", APTA Conference, Jun. 5-8, 1988, Westinghouse Transportation Systems and Support Division.

*Primary Examiner*—Andres Kashnikow
*Attorney, Agent, or Firm*—Spencer & Frank

[57] ABSTRACT

A single turnout rotary guideway switch is provided with an elongated structural frame member having guidebeam, electric rail and tire path structure on each of two sides of the switch compatible with the guidebeam, electric rail and tire path structure of the guideway. Switching is achieved by rotating a movable part of the switch 180 degrees about its longitudinal axis. One elongated beam acts as a principal structural member of the frame and provides a tire path on one of the switch sides for main line car routing by the switch. Another curved beam is secured between the one beam and another elongated beam that extends generally parallel to the one beam. The curved beam cross-supports the frame and provides a tire path on the other switch side for car turnout routing by the switch. In a crossover switching station in a dual lane guideway, a pair of the single turnout rotary switches are combined with an interface guideway section to provide for lane-crossover car routing by the switches.

22 Claims, 17 Drawing Sheets

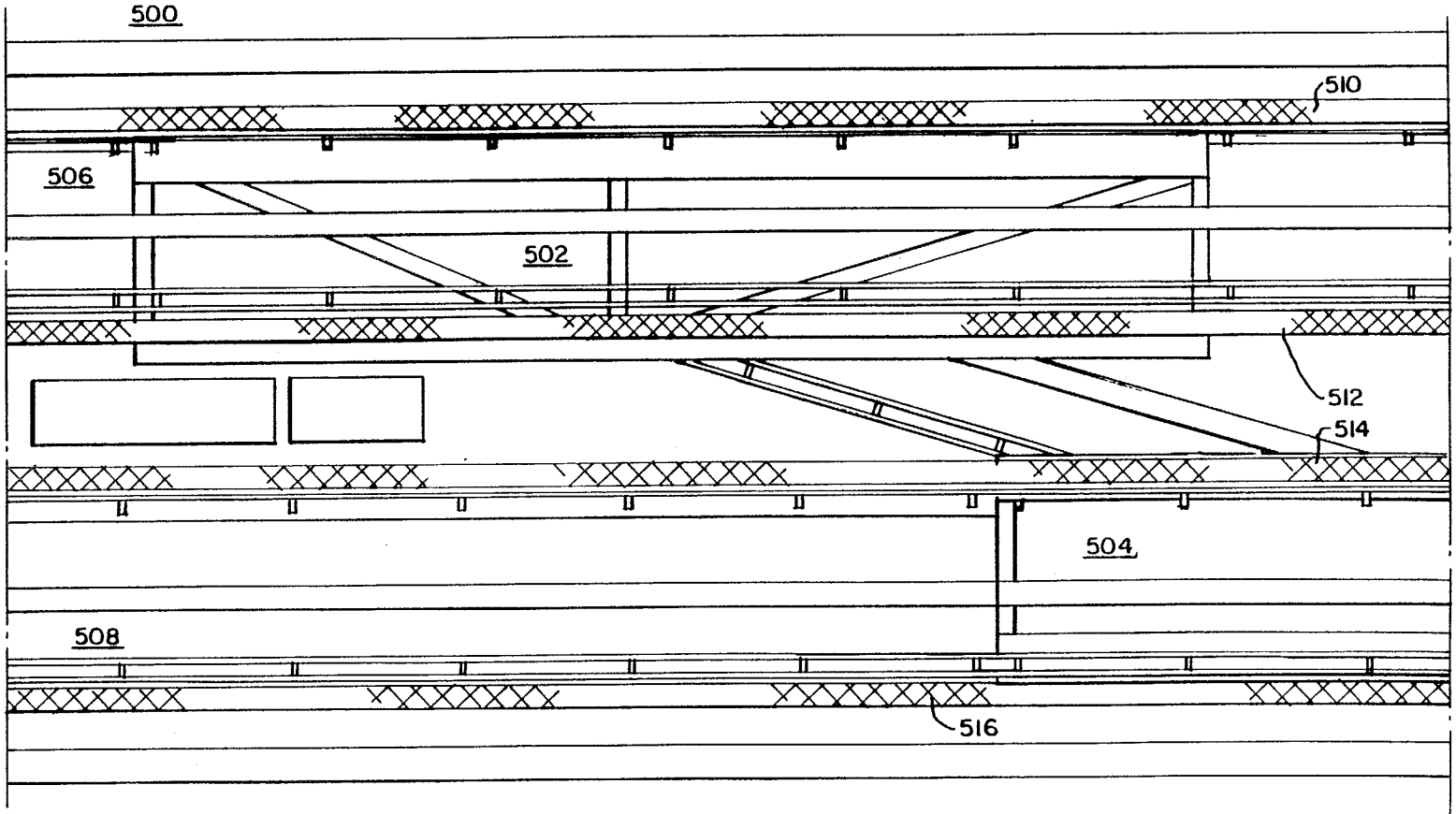
FIG. 6A1.

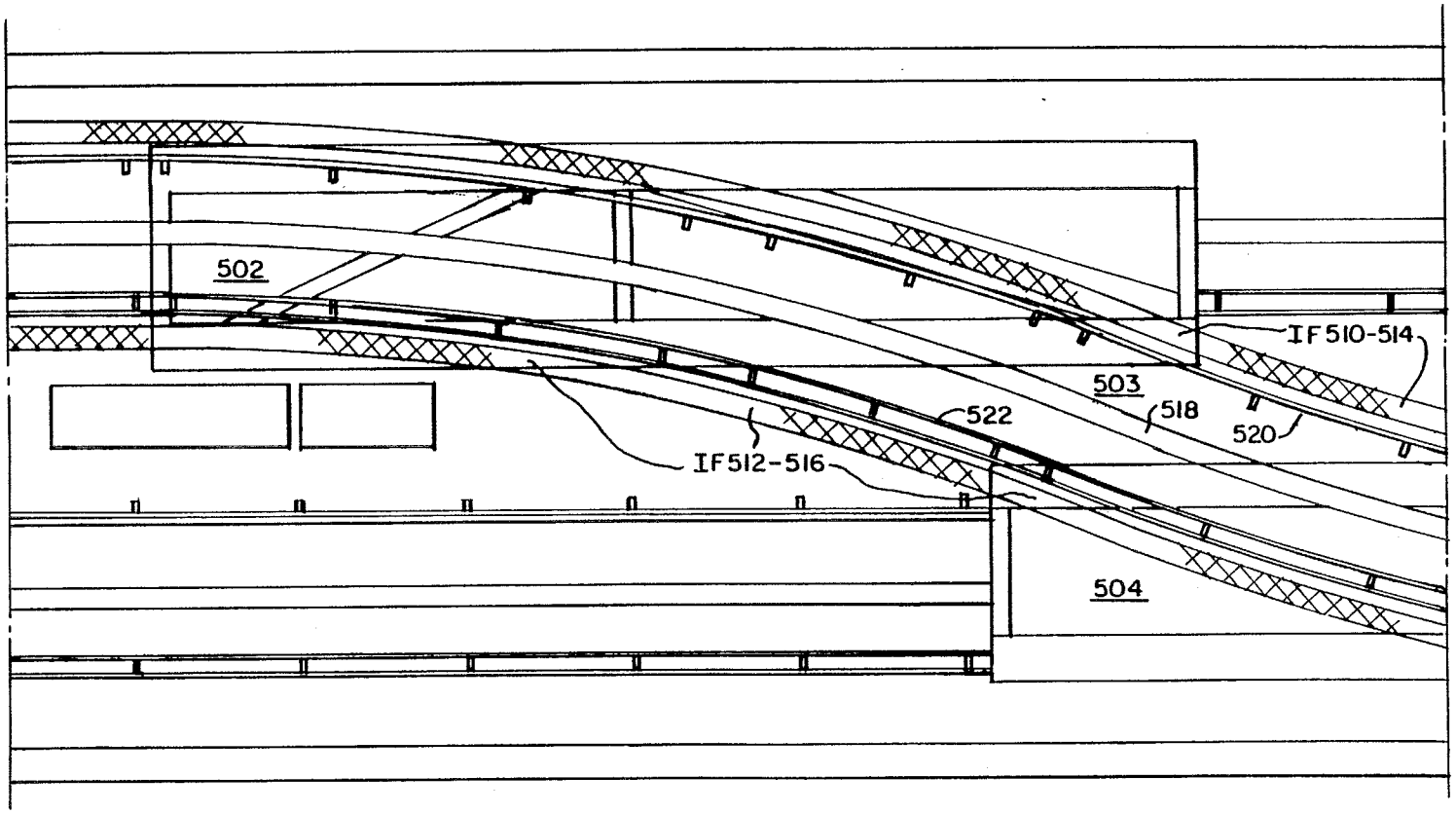
FIG. 6A2.

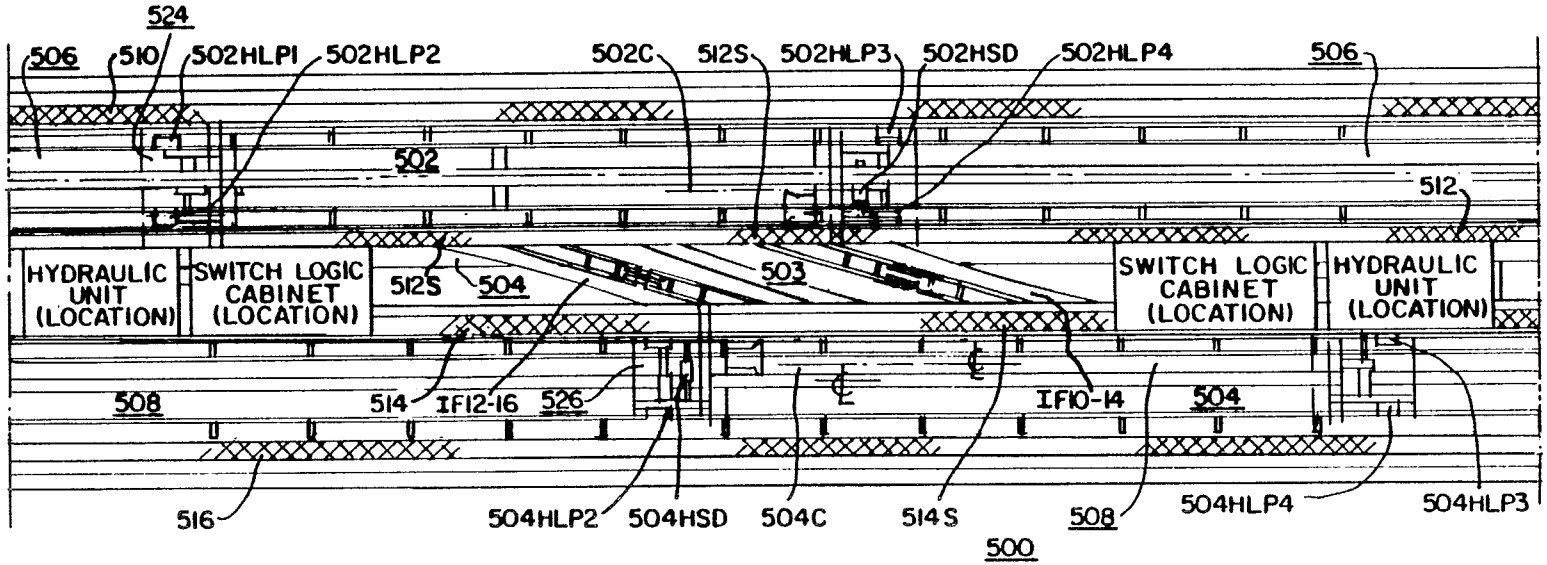
FIG. 6A3.

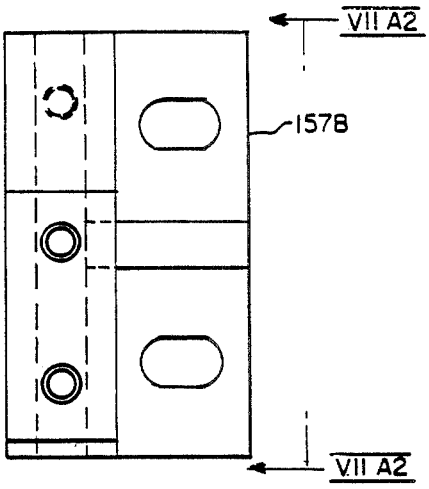
FIG. 7A1.
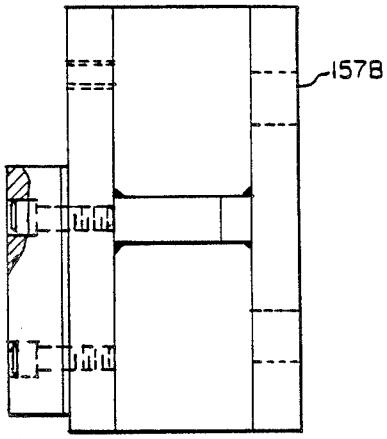
FIG. 7A2.
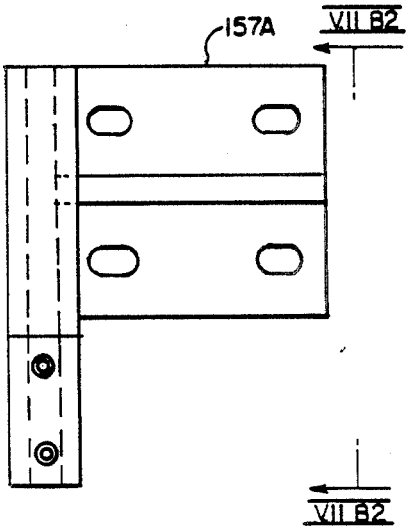
FIG. 7B1.
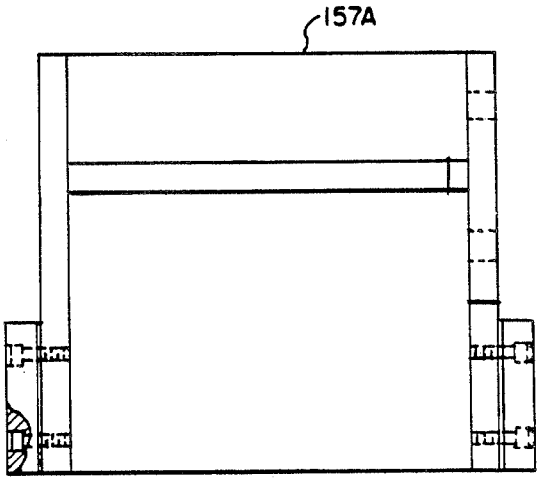
FIG. 7B2.

SINGLE TURNOUT ROTARY GUIDEWAY SWITCH AND A DUAL LANE CROSSOVER STATION EMPLOYING THE SAME

CROSS REFERENCE TO RELATED APPLICATIONS

The following related and concurrently filed and coassigned patent applications are hereby incorporated by reference:

U.S. patent application Ser. No. 07/211,723, filed concurrently, entitled ROTARY GUIDEWAY SWITCH FOR PEOPLE MOVER SYSTEMS and filed by Thomas J. Burg, William K. Cooper, Robert J. Anderson, Ronald H. Ziegler and John W. Kapala.

U.S. patent application Ser. No. 07/213,206, filed concurrently, entitled ELECTRIC COUPLING FOR ROTARY GUIDEWAY SWITCH and filed by Thomas J. Burg.

U.S. patent application Ser. No. 07/211,734, filed concurrently, entitled SAFETY LOCKING STRUCTURE FOR A ROTARY GUIDEWAY SWITCH and filed by Thomas J. Burg, William K. Cooper and Robert J. Anderson.

U.S. patent application Ser. No. 07/211,725, filed concurrently, entitled GUIDEWAY STATION FOR A ROTARY GUIDEWAY SWITCH and filed Thomas J. Burg, Robert J. Anderson and Ronald H. Ziegler.

U.S. patent application Ser. No. 07/211,726, filed concurrently, entitled ROTARY GUIDEWAY SWITCH HAVING SINGLE TIRE PATH LOADING and filed by Thomas J. Burg, William K. Cooper, Robert J. Anderson, Ronald H. Ziegler and John W. Kapala.

U.S. patent application Ser. No. 07/211,735, filed concurrently, entitled SELF-ALIGNING ROTARY GUIDEWAY SWITCH and filed by Thomas J. Burg.

U.S. patent application Ser. No. 07/211,723, filed concurrently, entitled DOUBLE TURNOUT ROTARY GUIDEWAY SWITCH and filed by Thomas J. Burg, William K. Cooper, Robert J. Anderson, Ronald H. Ziegler and John W. Kapala.

U.S. patent application Ser. No. 07/211,721, filed concurrently, entitled IMPROVED ELECTRIC, GUIDANCE, AND TIRE PATH CONFIGURATION FOR A PEOPLE MOVER GUIDEWAY and filed by William K. Cooper, Thomas J. Burg, and John W. Kapala.

U.S. patent application Ser. No. 07/211,724, filed concurrently, entitled ROTARY GUIDEWAY SWITCH HAVING GUIDEBEAM AND/OR ELECTRIC RAIL STRUCTURE LOCATED ABOVE AND BETWEEN GUIDEWAY TIRE PATHS, filed by Thomas J. Burg, William K. Cooper, Robert J. Anderson, Ronald H. Ziegler and John W. Kapala.

BACKGROUND OF THE INVENTION

The present invention relates to people mover systems and more particularly to guideway switches for such systems.

In cross referenced basic U.S. patent application Ser. No. 07/211,723, a general background description is presented and there is disclosed the structure and operation of a new rotary guideway switch and a new guideway configuration for people mover systems. That disclosure embodies a plurality of basic and improvement inventions and accordingly a family of patent applications, including the present application and those applications listed in the Cross-Reference section, are being filed concurrently in correspondence to the respective inventions.

The present patent application is directed to a rotary guideway switch that is structured to provide car switching between a main lane and a single turnout path. In dual lane guideway applications, a pair of the single turnout rotary switches provide smooth crossover switching while providing for significant savings in guideway construction.

SUMMARY OF THE INVENTION

A single turnout rotary guideway switch is provided for a people mover guideway system having a predetermined tire path, guidebeam and electric rail configuration. The rotary switch routes a transit car from a main lane entry guideway path to a main lane exit guideway path or a turnout guideway exit path.

The switch comprises an elongated structural switch frame member having guidebeam, electric rail and tire path structure on one side compatibly with the guideway configuration to provide car routing to the main lane exit path. The switch frame member further has with guidebeam, electric rail and tire path structure on another side compatibly with the guideway configuration to provide car routing to the turnout exit path. The frame is supported for operation by a pair of shafts and locking means at the opposite frame ends.

At least one of the shafts is driven to rotate the switch frame between first and second rotational positions. The switch frame has its one side aligned with the entry guideway path and the one exit guideway path in the first frame position and it has its other side aligned with the entry guideway path and the other exit guideway path in the second frame position. In the preferred embodiment, at least one elongated straight beam means operates as a principal structural member for the frame and provides a tire running surface for main lane car routing over the one switch side. Another curved beam means is connected to the one beam and operates as a principal cross-structural support for the frame and provides a tire running surface for car turnout routing over the other switch side.

In applying the single turnout rotary guideway switch to car crossover operation, a dual lane people mover guideway, having the predetermined tire path, guidebeam and electric rail configuration, is provided with a crossover switching station in which a pair of the rotary switches are disposed. The crossover switching station provides for routing a transit car from an entry guideway path in either lane to an exit guideway path in the same lane or an exit guideway path in the other lane.

Thus, a dual lane guideway section is structured at its entry and exit points to provide the predetermined guideway configuration including a pair of spaced tire paths for cars operating in the people mover system. A first rotary switch frame is assembled with the crossover guideway section in a first lane of the dual lane guideway and it is structured on one side compatibly with the guideway configuration to provide car routing from the entry path to the exit path in the same lane. The switch frame is structured on its other side to provide car crossover routing between the lanes.

A second rotary switch frame is assembled with the crossover guideway section in the second lane and it is structured on one side to provide car routing from the entry path to the exit path in the same lane. The second switch frame is further structured on its other side to provide car crossover routing between the lanes.

Finally, crossover guideway means is structured with the guideway configuration and interfaces the first and second switch frames to provide the crossover path for car crossover between the lanes when said switch frames are position for car crossover.

DESCRIPTION OF THE DRAWINGS

The invention is described below with reference to the accompanying drawings, a brief description of which follows. The Figure numbers of sectional views are keyed to reference planes denoted by Roman numerals and letters. For example, the sectional view of FIG. 4A is through reference plane IV a in FIG. 4.

FIG. 1B highlights the guideway configuration at a typical cross section of the guideway with a vehicle on it;

FIG. 5E is a similar view as FIG. 5D, showing an inactive switch;

FIGS. 6A1, 6A2 and 6A3 are top plan views showing the preferred embodiment of the invention in which a crossover guideway switch arrangement employs a pair of single turnout rotary guideway switches disposed in main lane positions (FIGS. 6A1 and 6A3) or turnout positions (FIG. 6A2);

FIGS. 7A1 through 7B2 show various views of rotation safety stop structure for the single turnout switch embodiment.

DESCRIPTION OF THE PREFERRED EMBODIMENT

Guideway System

Figure 1:
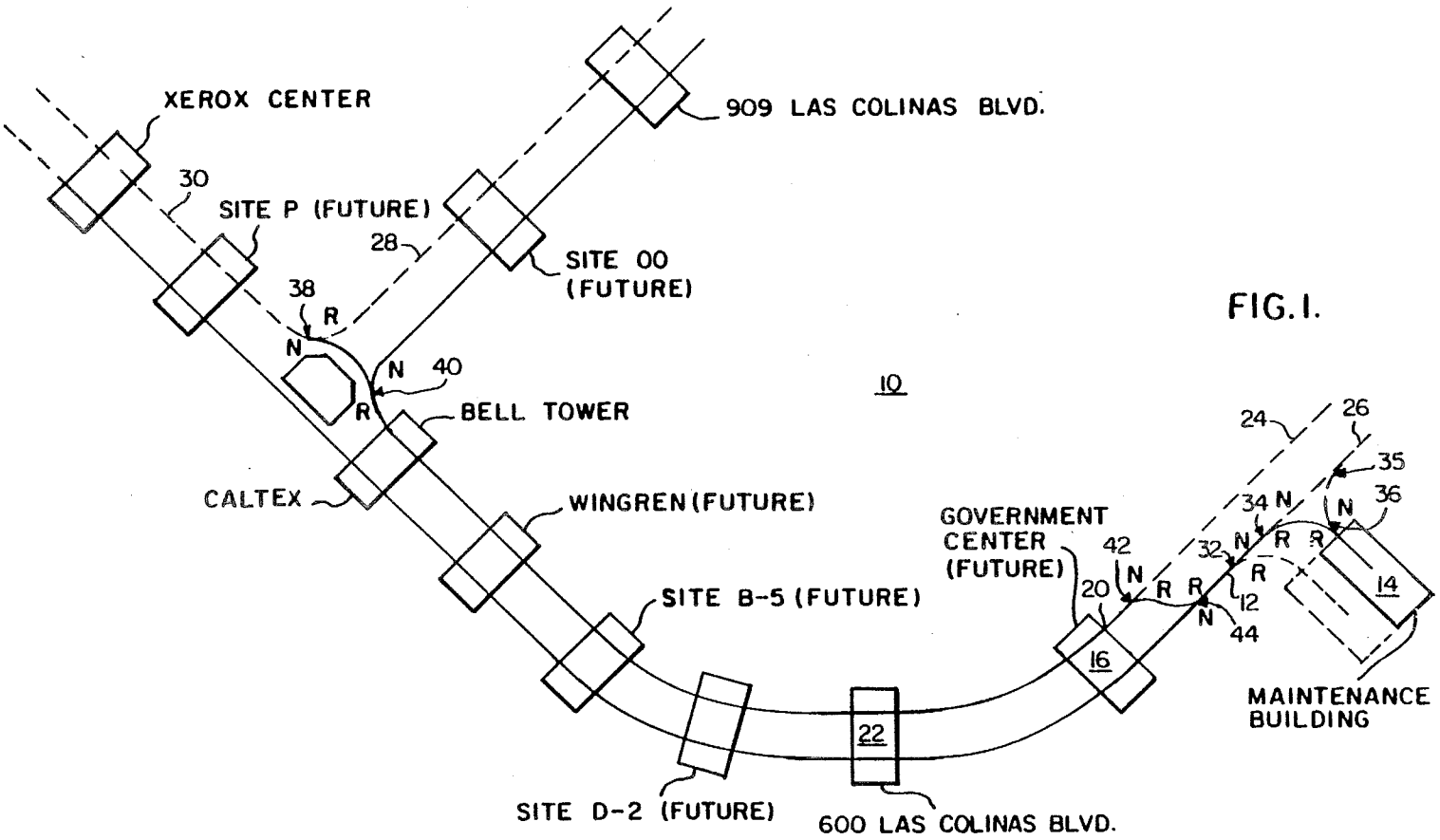
FIG. 1 shows a schematic diagram of a guideway layout for a people mover system having rotary guideway switches made and operated in accordance with the principles of the invention.
Figure 1A:
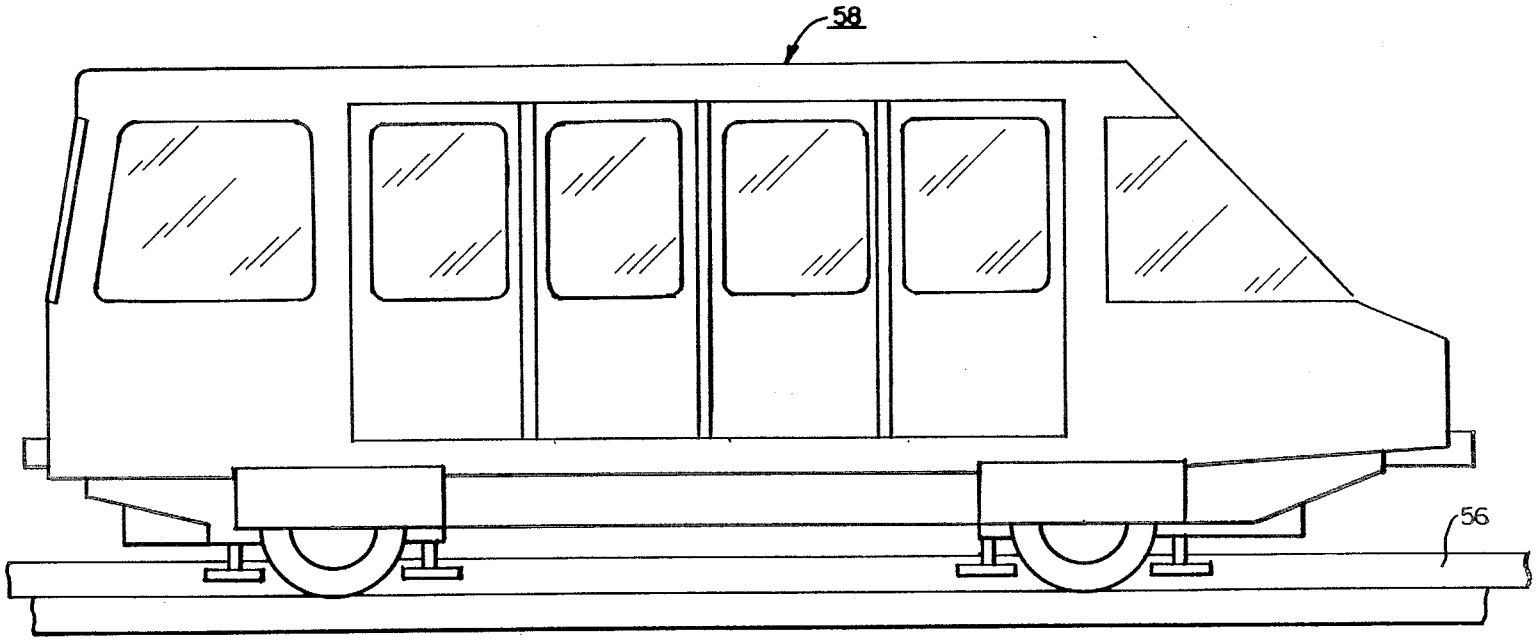
FIG. 1A shows an elevational view of a vehicle of the type employed on the guideway of FIG. 1.
Figure 18:
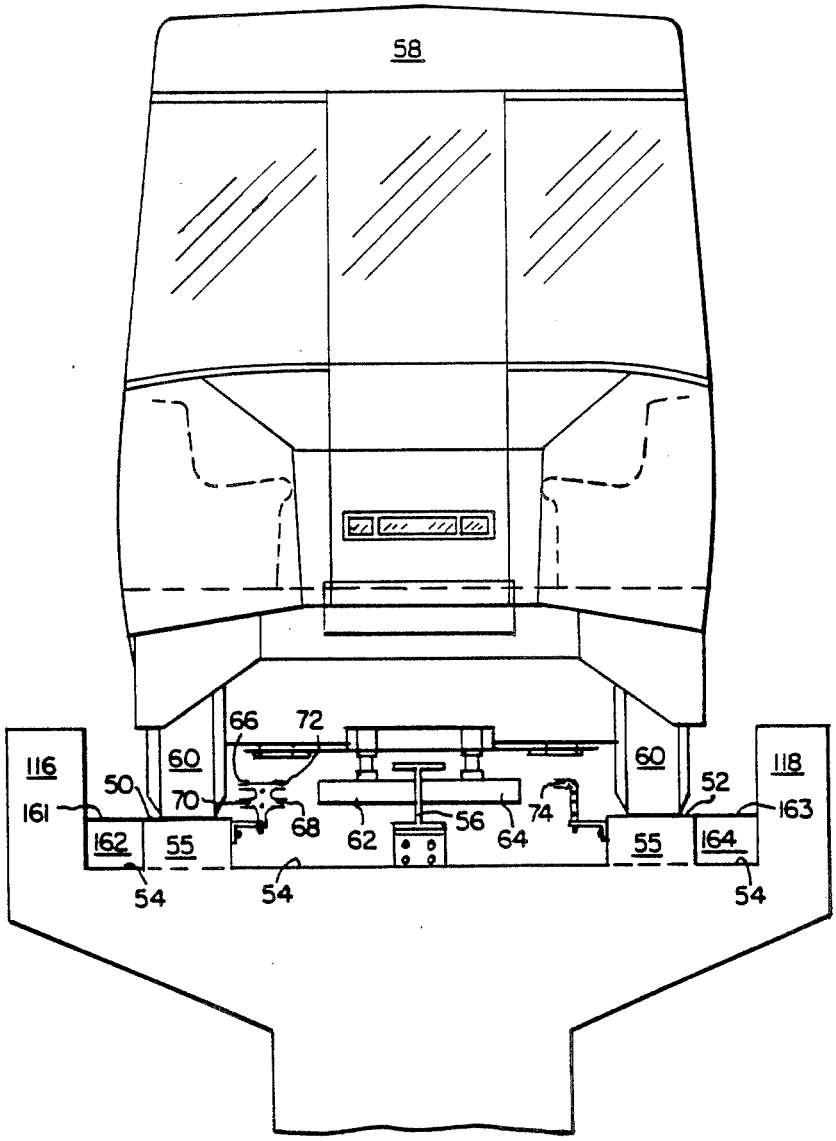

More particularly, there is shown in FIG. 1 a people mover system 10 in which the present guideway switch invention is embodied. The system 10 is a schematic representation of Phase 1 of a people mover system being commercially supplied by the assignee of the present invention to a location in Texas and referred to as the Las Calinas Area Personal Transit System.

The system 10 includes a first guideway lane 12 which extends from a maintenance building 14 to a Government Center Station 16 through various other stations to a Xerox Center Station which is currently the last station on the guideway lane.

A second guideway lane 20 extends from the station 16 to a Las Colinas Boulevard Station 22. Normally, where guideway lanes are placed beside each other along a common run, it is desirable that the lane spacing be minimized consistent with operating requirements because of construction and land costs. Once the lane spacing is defined, it is highly desirable that any guideway switches needed for lane switching be structured so that they can be located within the available lane space without requiring costly widening of the lane spacing around the switch locations. In the present case, the spacing between lane centerlines is 11 feet.

Dotted guideways 24, 26, 28, and 30 represent planned future guideway additions. Various additional stations are provided for the guideways as indicated by the illustrated blocks with accompanying station names.

In the present system configuration, right hand single turnout guideway switches 32 and 34, as well as a planned future left hand single turnout switch 35, are located near the Maintenance Building. A double turnout guideway switch 36 is also located nearest the Maintenance Building and two double turnout guideway switches 38 and 40 are located near the Caltex station.

Guideway switches 42 and 44 provide a crossover between the lanes 12 and 20 of a dual guideway. The crossover guideway switches 42 and 44 are right hand single turnout switches which provide the lane crossover routing without requiring widening of the specified guideway lane spacing. Use of transfer tables, pivotal switches and other prior art schemes would require lane widening for switch placement.

Guideway Configuration

Figure 1C:
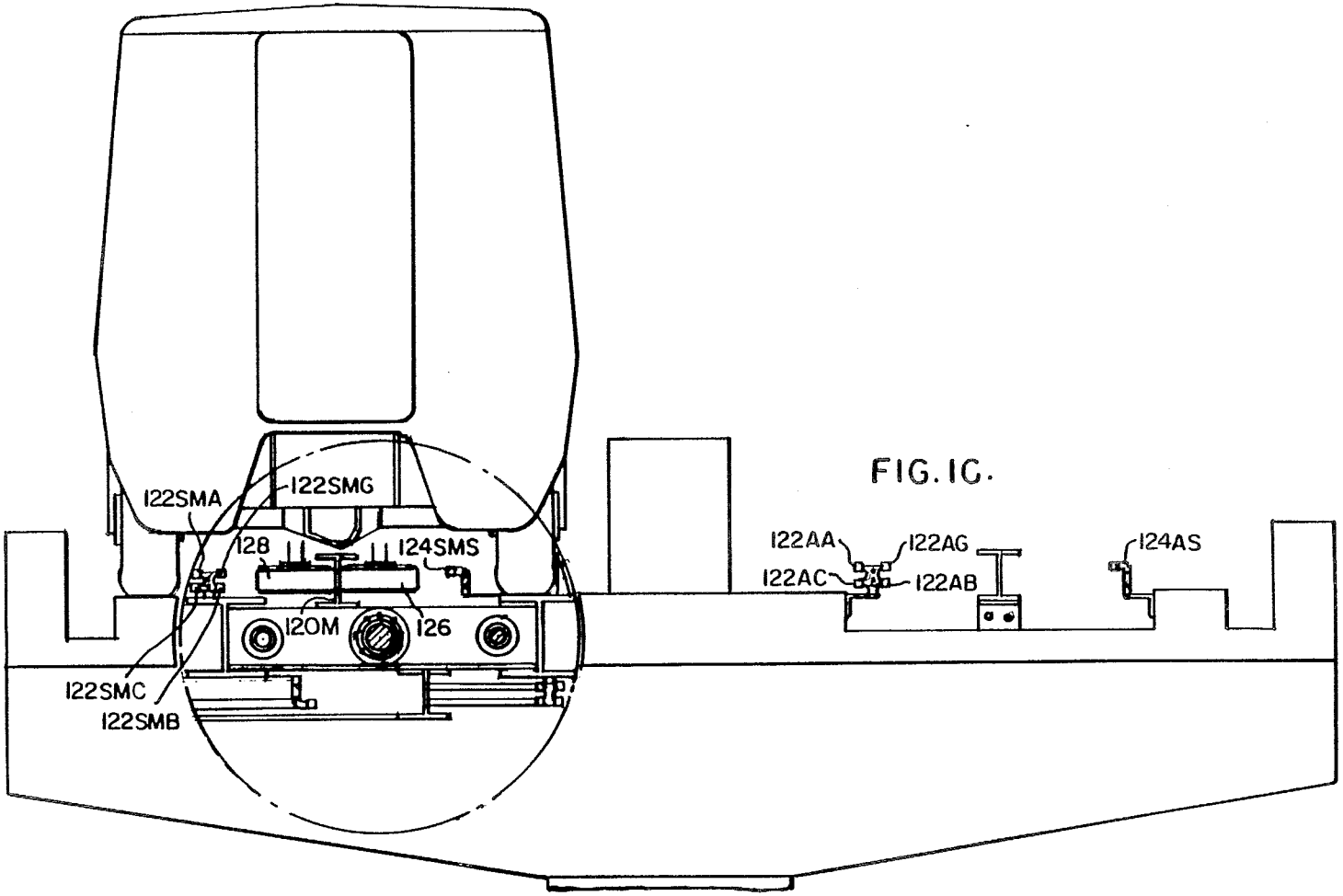
FIG. 1C shows a cross section of a dual lane portion of the guideway at a switch location thereby highlighting the configuration of the rotary guideway switch and its match with the guideway configuration.

The guideway configuration is illustrated in FIG. 1B by means of a cross-sectional view of the elevated guideway with a vehicle on it. FIG. 1C shows the guideway configuration at a guideway switch location. Generally, the guideway can be structured so that the vehicle tire running surfaces are above or below or at ground level. A vehicle 58 is provided with rubber tires 60 that propel the vehicle 58 when running vertically on surfaces 50 and 52.

As shown, the guideway tire running surfaces 50 and 52 can be spaced surface portions running along the length of the surface of an elongated concrete guideway slab 54. In this case, it is preferred that the running surfaces be provided on pads 55 elongated in the longitudinal direction and extending slightly upwardly from the concrete guideway structural slab 54. Cable troughs 162 and 164 are respectively provide outwardly of the tire running pads. Metallic covers 161 and 163 are provided for the troughs 162 and 164. If the vehicle should become disabled and stop at any point along the guideway, the surface of the cover 161 and the tire pad surface 50 together and the surface of the cover 163 and the pad tire surface 152 together form respective sidewalks for passenger use.

A guidebeam 56 is supported by the slab 54 and extends along the slab 54 midway between the running surfaces 50 and 52. The vehicle 58 carries guide wheels 62 and 64 having rubber tires that run horizontally along the guidebeam structure provided by successive guideway slabs to provide lane guidance for the vehicle 58.

Electric rail structure runs along the length of the guideway slab and is supported above and to one side of each of the running surfaces. Generally, the rail structure is configured to provide electric power for vehicle propulsion and electric signals for vehicle control.

Specifically, rails 66, 68 and 70 carry power current for the vehicle 58 and rails 72 and 74 carry central station control signals for directing vehicle operation on the guideway.

In the preferred guideway configuration, the electric rail and guidebeam structure is located above and between the vehicle tire paths and it is organized to enable continuous current collection through continuous electric railing at guideway switch locations without mechanical on/off rail ramping of the car collector assemblies. By this location definition it is meant that the current collection surfaces on the electric rails and the guidance surface on the guidebeam are located above and between the tire surfaces. Normally most or all of the guidebeam and electric rail structure would thus be above the reference plane through the tire paths, but some portions of this structure may be located below the tire path reference plane so long as the current collection and guidance surfaces are located above this reference plane and between the tire paths. Current collection and guidance hardware on the underside of the vehicle can thus be designed to provide (1) specified ground clearance for the underside of the vehicle; (2) in conjunction with the rail structure, completely reversible vehicle operation on the guideway; and (3) in conjunction with the rail structure, continuous current collection through guideway switch locations without mechanical on/off rail ramping of the vehicle collector assemblies.

Further, the running surface, electric rail and guidebeam structure is preferably symmetrically disposed on the two sides of the guideway lane centerline thereby enabling turnaround operation of vehicles on the guideway. By turnaround operation, it is meant that either end of the vehicle can be the leading vehicle end for vehicle travel over a guideway lane in either guideway direction with guidance and current collection functions being provided in both directions of vehicle travel. Generally, turnaround operation is enabled by the described symmetric disposition of electric rail and guidebeam structure and cooperative placement of guidewheel and collector assemblies on the underside of the vehicle.

For more information on the background, functions and advantages of the illustrated guideway configuration, reference is made to the cross-referenced copending patent application Ser. No. (54,460).

Single Turnout Rotary Guideway Switch

A single turnout rotary guideway switch 100 (FIGS. 2A, 2B and 3) is arranged in accordance with the invention to provide for vehicle turnout from a main guideway lane to a turnout lane. In the preferred invention embodiment considered more fully subsequently herein, a pair of switches 100 provide for vehicle crossover from one lane to another lane of a dual lane guideway.

In one rotary position referred to as the tangent rotary position, the upper side of the guideway switch 100 provides a guideway configuration (guideway, guidebeam, and rail structure) that keeps the vehicle in the lane in which it is moving. When the guideway switch 100 is rotated, preferably through 180 degrees, the previous lower side of the guideway switch 100 becomes the upper switch side and it provides a guideway configuration that directs the vehicle from the lane in which it enters the switch (1) over a turnout path on the switch to a turnout lane or, alternatively, (2) over a crossover path to the other lane of a dual lane guideway. In the latter case, the crossover path leads to another rotary guideway switch 100 located in the other lane and rotatively positioned to direct the vehicle onto the other lane.

Generally, the rotary guideway switch 100 is structured to expose the vehicle as it moves through the switch 100 to a guideway cross-section that is essentially the same as that which exists elsewhere along the guideway. Electrical contact with power and signal rails is continuous as the vehicle moves through the guideway switch 100 in either guideway switch position.

Crossover on a dual lane guideway is achieved without requiring that normal guideway spacing be increased or bulged to permit guideway switch installation. Normally, the spacing of dual guideway lanes is made as small as possible to economize on land and construction costs without sacrificing safety, operational and aesthetic requirements.

Further, as will become more evident hereinafter, self-aligning, failsafe operation of the rotary guideway switch 100 results where the weight of the vehicle load and the switch itself maintain the switch in its existing rotational position. System safety is thereby significantly enhanced.

Preferably, only one of the two guideway tire paths is provided on the tangent side of the switch frame 110. The substantial equivalent of one guideway path (i.e. a portion of each of the two tire paths that together substantially correspond to one path) is preferably provided on the turnout side of the switch frame 110. In this manner, the different guideway configurations required for the two different guideway switch positions can be provided with significant reduction in the switch load bearing requirements and in the switch weight and thus with significant economy and efficiency in switch design and operation.

In end effect, the described "single tire path" structure is a key to providing a minimum weight for a movable section of the guideway while meeting switching requirements. Thus, the same guideway configuration found outside the rotary switch is essentially duplicated by the switch section in both switch positions through rotation of the described rotatable switch element 110 without requiring rotation of the entire guideway cross-section.

The rotary guideway switch 100 is characterized with design flexibility especially since it is readily adaptable to meeting a variety of path switching needs. Among other benefits, its design flexibility additionally facilitates the development of switch designs for different radii of curvature specifications.

Figure 2B:
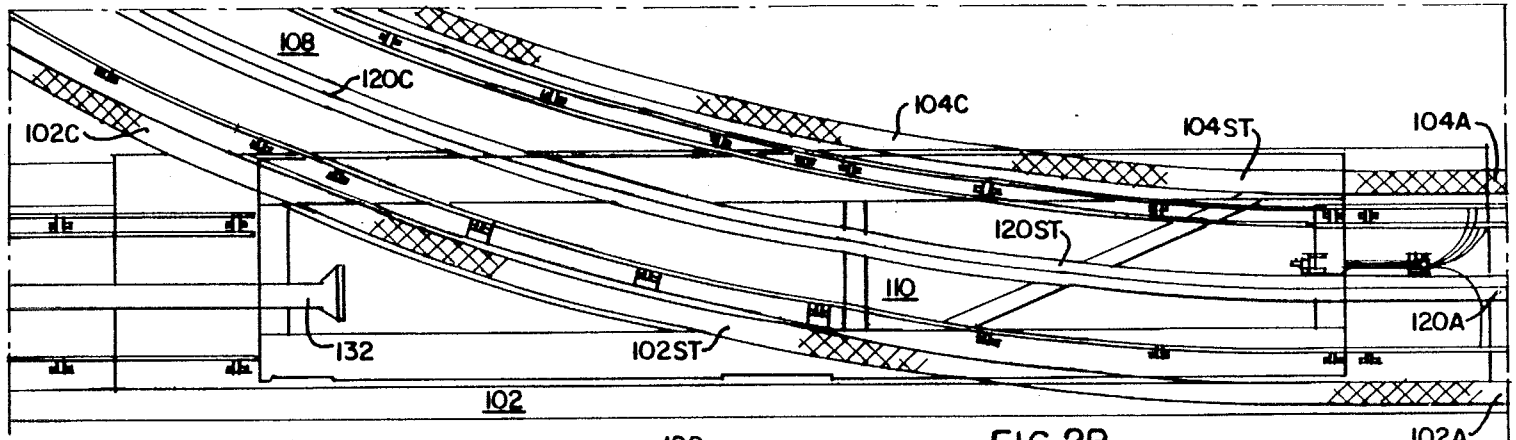
FIG. 2B shows the single turnout switch of FIG. 2A in its turnout position.
Figure 2A:
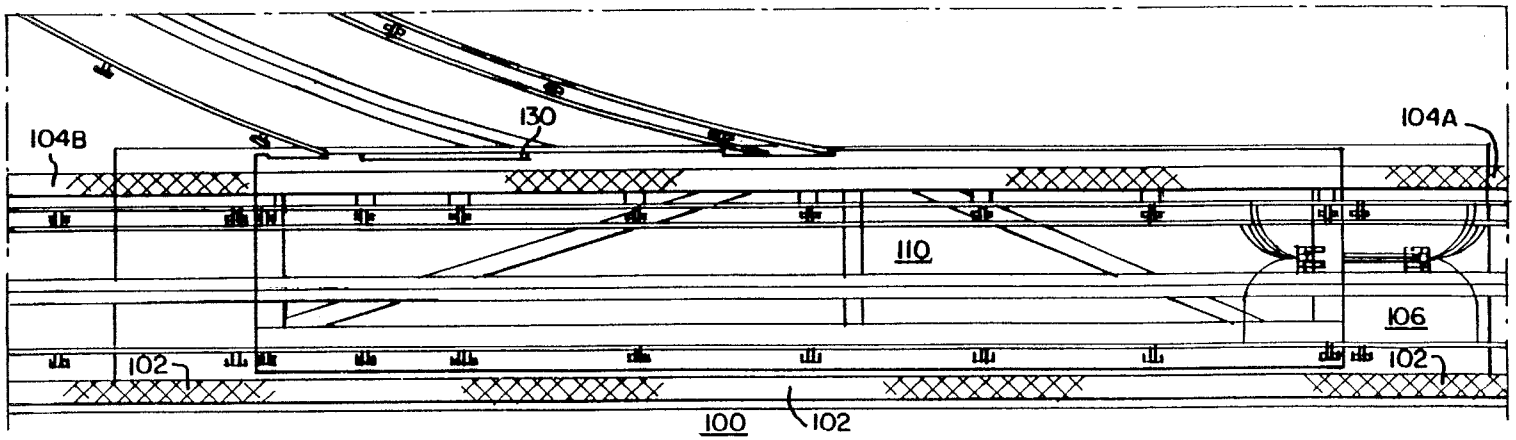
FIG. 2A shows a top plan view of a single turnout rotary guideway switch structured in accordance with the invention and positioned in its tangent or main lane position in a lane turnout implementation of the invention.

There is shown in FIG. 2A a section of a guideway having the single turnout rotary guideway switch 100 in its tangent position. Accordingly, a vehicle is guided over tire running surfaces 102 and 104A, 104B along a main lane 106 as opposed to being switched onto turnout lane 108.

The rotary guideway switch 100 comprises a rotatable and in this case generally rectangular frame member 110 that is supported in a switch pit 112 (FIG. 3) for rotation about longitudinal centerline 112C. Hydraulic and electric operating equipment is also housed in the pit 112 at opposite ends of the frame member 110. Generally, switching is achieved by a hydraulic actuator that rotates the movable frame 110 through 180 degrees about a longitudinal axis from one of its aligned positions to its other aligned position. The switch is secured in either aligned position, preferably by four hydraulically actuated lock pins. More detail is presented subsequently herein on the switch operation.

The main guideway has longitudinally extending outer housing walls 116 and 118 within which the tire running surfaces 102 and 104, guidebeam 120, and power and signal rails 122A, 122B and 124A, 124B are provided. The tire pad with its surface 102 is included as part of the fixed guideway structure.

In the tangent switch position illustrated in FIG. 2A, the upper side of the guideway switch 100 is the tangent side which provides a tire running surface section 104SM (FIG. 3) that connects main lane tire running surface 104A with main lane tire running surface 104B for continued main lane vehicle operation. A guidebeam section 120SM on the switch movable element 110 connects guidebeam 120A to guidebeam 120B to keep the vehicle on the main lane 106 as it passes through the switch movable element 110. Power and signal rail sections 122A, 122B and 124A, 124B similarly provide main lane interconnections for continuous main lane vehicle electrical contact.

As shown in the cross-sectional view in FIG. 1C, horizontal guide wheels 126 and 128 guide the vehicle over the guideway along the guidebeam 120, in this case the switch guidebeam section 120M. Electrically conductive brushes on the vehicle provide circuit continuity with the electrical rail sections 122SMA, 122SMB, 122SMC, 122SMG, and 124SMS as the vehicle moves through the guideway switch 100.

In the turnout switch position illustrated in FIG. 2B, the guideway switch 100 is rotated so that the lower or turnout side of the switch element 110 in FIG. 2A becomes the upper side of the switch 100 in FIG. 2B. The turnout side of the switch 100 provides a tire running surface section 102ST and a short section 104ST that respectively connect tire running surface 102A and 104A on the main lane 106 with tire running surface 102C and 104C on the turnout lane 108 for vehicle turnout operation. A guidebeam section 120ST on the switch element 116 connects guidebeam 120A to guidebeam 120C to provide vehicle turnout guidance as the vehicle passes through the guideway switch 100. Power and signal rail sections 122C and 124C similarly provide connections for vehicle turnout operation (FIG 2C).

With main lane operation, the tire running surface 102 is on a pad that is part of the fixed guideway structure and the other tire running surface 104 includes the switch tire running surface 104SM. When the guideway switch element 110 is rotated to its other position, the main lane tire running surfaces 102A and 104A are coupled to turnout lane tire running surfaces 102C and 104C by the respective switch tire running surfaces 102ST and 104ST. Significant weight savings and size savings (i.e. radius of rotation) are thus achieved for the rotary guideway switch 100 thereby providing economy of switch manufacture and facilitated switch operation. Significant failsafe switch operation results from the fact that the vehicle weight always acts on the switch tire surface 104SM in the high speed main lane switch position to hold the switch element 110 in position against its safety stops even in the highly unlikely event that all lock pins would be in the unlocked position.

In the lower vehicle speed turnout switch position of this single turnout embodiment of the invention, the vehicle weight similarly acts to provide lock pin backup over a substantial part of the length of the switch element 110. As will become more evident hereinafter, switch geometry is or can be arranged in various embodiments of the invention to enable complete backup protection through vehicle weight action.

To provide protection against wrongful vehicle entry into a switch that is not aligned with the vehicle switch entry path, i.e. a switch aligned with the other guideway switch entry path, guide wheel stops are provided at the frog end of the switch. In FIG. 2A, stop 130 prevents a vehicle on turnout from entering from the frog end of the switch. In FIG. 2B, stop 132 prevents a vehicle on the main lane from entering from the frog end of the switch.

Single Turnout—Switch and Equipment Location

Figure 3:
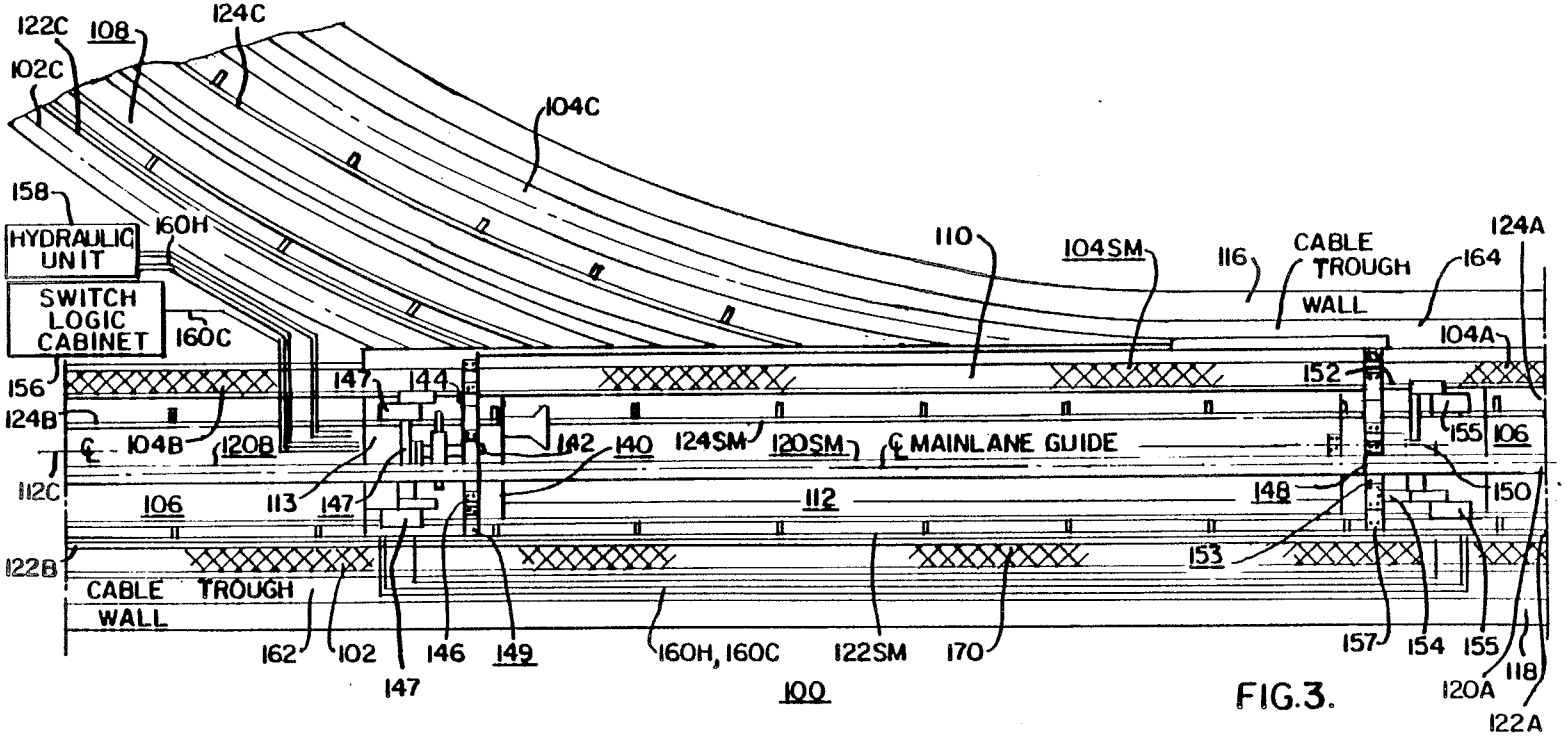
FIG. 3 is a top plan view showing a more detailed top plan view of a general assembly of the single turnout, rotary guideway switch positioned in its main lane position.

In FIG. 3, the single turnout rotary guideway switch 100 is shown with more detail that highlights the location of various structural and equipment items. The switch 100 includes a rotatable frame, a pit for the frame, and other fixed components. The switch pit 112 is an elongated cavity located within the guideway structure to house the generally elongated rotary guideway switch 100 for rotation and to house the equipment and structure needed to drive and support the guideway switch 100. Thus, the pit 112 is roughly subdivided into a main pit (31.5 feet long in this embodiment), a frog end equipment pit (4feet long) and a point end equipment pit (4 feet long).

The switch rotation occurs about longitudinal centerline 112C. In moving from the tangent position shown in FIG. 2C to the turnout position, the guideway switch 100 rotates in the clockwise direction about the centerline 112C as viewed from the left side of FIG. 3. As previously considered, the tangent side of the switch 100 provides tire running surface and guidebeam and electrical rail structure appropriate to main lane routing. The turnout side of the switch 100 is appropriately configured for turnout routing.

A fixed or frog end 140 of the guideway switch 100 is supported by a drive shaft 142 and lock pins 144 and 146. Pit space 113 is provided adjacent to the frog end 140 of the switch 100 to house electrohydraulic equipment 147 that drives the frog end switch shaft 142 for switch rotation and operates the frog end lock pins 144 and 146.

A fixed equipment frame 149 supports the drive shaft 142 and the lock pins 144 and 146. The fixed equipment frame 149 additionally includes a rotation safety stop 157A (FIG. 4) that provides backup engagement with a movable switch frame 110 of the switch 100 in its main lane position, i.e. the position shown in FIG. 3. The inserted lockpins provide the primary definition of the main lane switch position, and the backup stop 157A (FIG. 4) secondarily defines the main lane switch position in the event the lockpins 144 and 146 are unlocked for some reason. Thus, in the higher speed main lane switch position, vehicle weight is applied over the entire path of vehicle travel against the movable switch frame 110 always to force the switch frame to rotate toward the fixed frame stop 157A. As subsequently considered more fully, the rotary frame weight distribution also causes the switch frame 110 to rotate toward the stop 157A.

A point or expansion end 148 of the guideway switch 100 is supported by a shaft 150 and lock pins 152 and 154. Another fixed equipment frame 153 supports the shaft 150 and the lock pins 152 and 154. The frame 153 also supports electrohydraulic equipment 155 for operating the point end lock pins 152 and 154.

The fixed equipment frame 153 also includes a rotation safety stop 157 (see FIG. 4 series) that engages a switch frame portion as a backup for the switch 100 in its turnout position. The stop 157 thus secondarily defines the turnout position of the switch element 110, with the primary turnout position definition provided by the lockpins 152 and 154 when they are inserted into the switch element 110. If all of the switch lock pins are unlocked for some reason in this embodiment, the stop 157 acts as a backup support for the switch frame 110 in its turnout position during the portion of vehicle travel over the switch 100 when the vehicle weight and the switch frame weight urges the switch toward the fixed frame stop 157.

The single turnout switch frame structure can be basically organized like the double turnout switch structure subsequently described herein to adjust the interface between the fixed structure tire path and switch tire path such that the switch tire path geometry enables the vehicle weight to push the switch against its turnout position stop over the entire switch tire path. In that case, continuous and complete backup rotation stop support is also provided in the turnout position of the single turnout switch.

A switch logic cabinet 156 and a hydraulic unit 158 are located outside the guideway structure to provide for guideway switch control and operation. A control conduit 160C and hydraulic lines 160H are routed through the guideway concrete structure for connection to the electrohydraulic equipment 147 and 155. Cable troughs 162 and 164 are provided for routing system signal lines along the entire length of the guideway, and, as shown, the troughs can also be used to route the electrical and hydraulic lines 160C and 160H locally from one end of the pit 112 to the other pit end.

To assure smoothness in the vehicle ride while providing more than adequate space tolerance for switch rotation, the spacing between each end of switch 100 and the adjacent fixed equipment frame 149 or 153 is preferably nominally ½ inch. Moreover, in constructing the guideway system, the equipment frames are secured in place with tolerances that assure placement of the rotary switch 100 such that its upper side configuration in either rotational position is in configuration alignment with the adjacent fixed guideway structure.

Single Turnout Switch-Frame Structure and Switch Assembly

Figure 4:
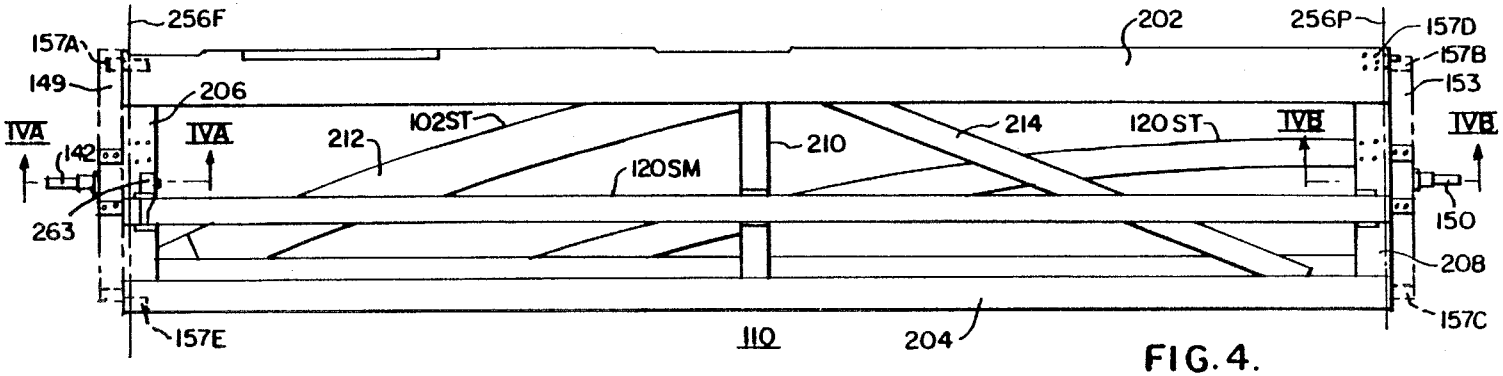
FIG. 4 shows a top plan view of a single turnout rotary frame assembly that includes a portion of the fixed frame supports and a movable part of the guideway switch.

In FIG. 4, the tangent or main lane side of the single turnout rotary guideway switch rotating frame 110 is shown in a plan view. The basic structure of the switch 100 formed by a generally elongated structural frame member 110 comprising parallel longitudinal structural I beams 202 and 204 and frog end, point end and center cross I beams 206, 208 and 210.

From a strength standpoint, the switch framework is arranged to meet all structural and vehicular induced loads within tolerable bending and torsional stresses and specified maximum deflection. From an electrical standpoint, the switch is structured to provide power and signal rail continuity for a vehicle as it enters, passes through and exits the switch.

Generally, the length of the frame 110 is based on the specified radius of curvature for the turnout path at the switching area. A greater radius of curvature requires a greater switch length. In this case, the switch length is approximately thirty-one feet.

The width of the switch frame 110 is preferably less than the overall distance between the tire paths, but the frame width is sufficient to provide the necessary interface width of turnout guideway path on the turnout side of the switch 100 (with the main lane tire path fixed on the side opposite the turnout side). In this way, the rotary switch 100 can be structurally designed with economy for partial car loading as opposed to full car loading. Further, the weight of the rotary switch itself is limited and the rotational diameter of the rotary switch 100 is limited thereby enabling economy in the switch and guideway pit structure and facilitating the operation of the rotary switch 100. In particular, the relatively small size and weight of the switch rotating frame 110 produces efficiency allowing low operational horsepower requirements (less than two horsepower in this application).

The switch frame width in this embodiment is such that the longitudinal beam 202 provides a tire path on the main lane side of the switch 100 for the tires on one side of the vehicle, and the longitudinal beam 204 is placed to lie just inside and below the fixed structure path for the tires on the other side of the vehicle. Thus, only half of the vehicle weight is carried by the rotary switch frame 110 and its support structure in the main lane position.

As in the present case, the rotary switch frame length can be great enough in relation to the vehicle length that a portion of a second vehicle connected to the first vehicle may be located on the rotary switch frame 110 while the entire length of the first vehicle is on the switch frame 110. In that case, the rotary switch frame 110 is designed to support one half of the total vehicle weight that can bear on the main lane side of the rotary switch frame, i.e. the portion of the weight of the full first vehicle translated through the vehicle tires on one side of the vehicle and the portion of the weight of the connected vehicle translated through the single vehicle tire located on the rotary switch frame 110.

On its main lane side, the frame 110 is additionally provided with the main lane guidebeam section 120SM which is secured to the cross beams 206, 208, and 210. The power and signal rail structure is not shown in FIG. 3.

A curved beam 212 provides cross frame support in the diagonal direction between the longitudinal beams 202 and 204 such that it provides the turnout tire running surface 102ST on the turnout side of the rotary switch 100 (the underside of the frame 110 as viewed in FIG. 4). For structural purposes, a bracing I-beam 214 provides similar cross frame support in the opposite diagonal direction, The curved turnout guidebeam section 120ST is also provided on the switch turnout side.

Preferably, fiberglass grating is incorporated into the rotary switch frame to eliminate open areas between structural members and thereby facilitate maintenance and provide a secure stepping surface for passengers who may have to leave a vehicle that has had an emergency stop in the vicinity of a switch. Since the upper and lower sides of the switch frame are used for vehicle routing, the grating is installed to provide for loading on either side of the grating surface. Thus, the grating supports take loading in both directions.

Rotational backup stop action is provided at opposite ends of the switch framework. As indicated by dotted lines in the upper left hand corner of FIG. 4 (detail in FIGS. 7B1–7B2), the safety stop 157A is a stop secured to the frog end fixed equipment frame 149 and is structured and positioned such that its top surface provides stop support, and preferably backup stop support, for the underside of corner portion of top plate of the longitudinal I beam 202 of the frame 110.

Just prior to reaching the main lane stop position, the switch frame 110 is brought to a smooth stop in alignment for insertion of the primary frame supporting lock pins. The described stop structure acts as a backup support in the event lock pins fail to be inserted, i.e. the weight of the switch itself and any vehicle load pushes the switch frame a slight (less than 1/16") additional distance against the backup stop structure.

To enable the switch frame 110 to rotate into the main lane position shown in FIG. 4, the bottom plate of the longitudinal I beam 202 of the frame 110 is notched to remove its corner portion that would otherwise contact the frog end stop 157A and prevent the switch frame 110 from being rotated fully into its main lane position.

As shown in the upper right hand corner of FIG. 4, a safety stop 157D is also preferably provided on the point end of the rotary switch. In this instance, the stop 157D is secured to the rotary frame and it has a projecting finger that engages a stop structure 157B (detail in FIGS. 7A1–7A2) on the point end fixed frame 153 if lockpin support fails in the illustrated main lane position.

In the turnout position of the switch, the bottom surface of the frog end stop 157A similarly provides backup support for the inner surface (upwardly facing in the switch turnout position) of the abutting corner portion of the bottom (in turnout position) flange of the I beam 204. The opposite (top) flange of the I beam 204 is notched as indicated by 157E so that it can pass the stop 157A as the switch frame rotates into its turnout position. The point end stop structure 157C on the point end fixed frame 153 likewise provides backup support in the turnout position for frame stop structure 157D.

Figure 4B:
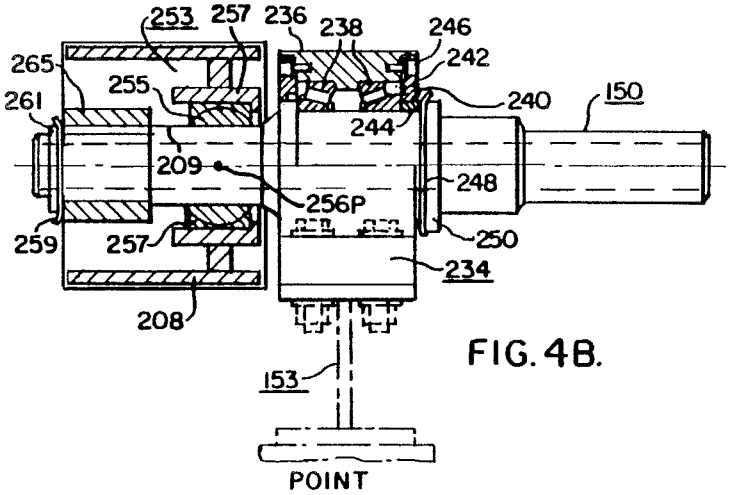
FIGS. 4A and 4B are views taken along the indicated reference planes in FIG. 3 to show the manner in which longitudinal rotary frame expansion is enabled by rolling or floating end beam support provided for the rotary frame by a point end shaft and with vertical support provided at both ends of the frame.
Figure 4A:
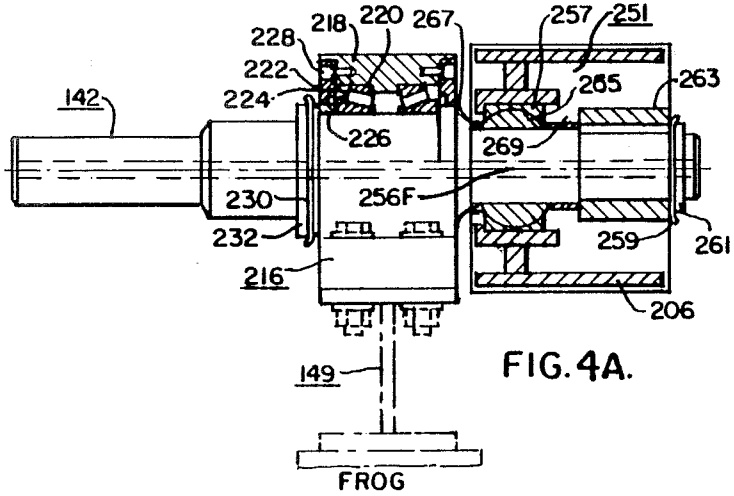

Support structures for the frog end drive shaft 142 and the point end shaft 150 are shown respectively in FIGS. 4A and 4B.

As shown, the drive shaft 142 is supported relative to the fixed equipment frame 149 by means of a fixed tapered roller bearing assembly 216 on which the switch frame is rotated. The tapered roller bearing assembly is a long-life, anti-friction unit that provides smooth operation and includes the following elements:

218 pillow block and grease fitting
220 bearing cone and bearing cup
222 bearing seal
224 seal retainer and gasket
226 bearing sleeve
228 screw
230 lock washer
232 locknut The point end shaft 150 is supported relative to the fixed equipment frame 153 by means of another fixed tapered roller bearing assembly 234 on which the switch frame is rotated. As above, the tapered roller bearing assembly 234 includes the following elements:

236 pillow block and grease fitting
238 bearing cone and bearing cup
240 bearing seal
242 seal retainer and gasket
244 bearing sleeve
246 screw
248 lock washer
250 locknut The two switch frame shafts 142 and 150 are respectively supported relative to the switch frame cross beams 206 and 208 by similar spherical bearing assemblies 251 and 253 which accordingly provide structural bearing for the switch frame. Each of the spherical bearing assemblies 251 and 253 includes the following elements:

255 spherical bearing supported on shaft
257 bearing seat
259 lock washer
261 locknut A crankarm 263 is provided with the bearing assembly 251 and another crankarm 265 is provided with the bearing assembly 253. Each crank arm 263 or 265 is secured to its shaft 142 or 150 and extends radially outwardly to a point where it has an end portion coupled to the switch frame cross beam 206 or 208. Accordingly, when the crank arm 263 (see the FIG. 4 series) is driven by the shaft 142, it provides rotational drive force for the switch frame 110. The crank arm 265 similarly connects the passive point end shaft 150 and frame end beam 208 for coupled movement. While the point end crank arm 265 transmits no drive force to the switch frame because the point end shaft 150 is free to rotate, it does tie the frame movement to the movement of the point end shaft 150 so that point end shaft position can be used to confirm the frame point end position with the frame frog end position with use of a position detection device.

The frog end bearing assembly 251 includes spacers 267 and 269 which fix the bearing 257 and the shaft 142 against relative movement in the axial direction. Thus, the frog end of the switch frame is fixed against movement in the longitudinal direction which could otherwise occur as a result of thermal expansion and contraction of the switch frame 110 or as a result of frame bending under vehicle load or vehicle braking or acceleration forces.

At the point end of the frame 110, spacers like the spacers 267 and 269 are omitted thereby enabling the frame point end to undergo longitudinal movement under thermal or vehicle load. In the illustrated embodiment, space is provided for about ⅜ inch outward (rightward) or longitudinal frame movement due to thermal expansion whereas the expected maximum outward movement is ¼ inch. As indicated by reference character 209, space is provided for about 1 inch inward (leftward) longitudinal frame movement due frame bending under vehicle load or due to thermal contraction or installation tolerances.

Figure 4D:
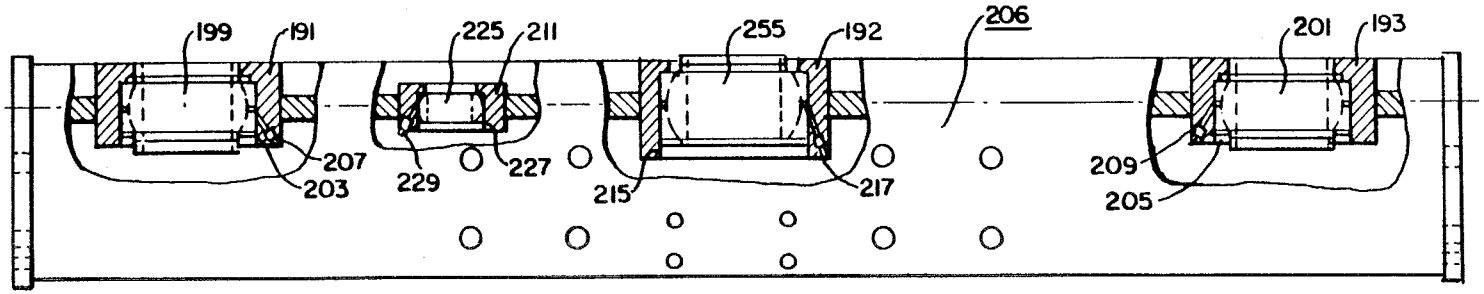
FIGS. 4C and 4D respectively are elevation and broken away top plan views of one of the frame end beams which receive lockpin and shaft support for the switch frame.
Figure 4C:
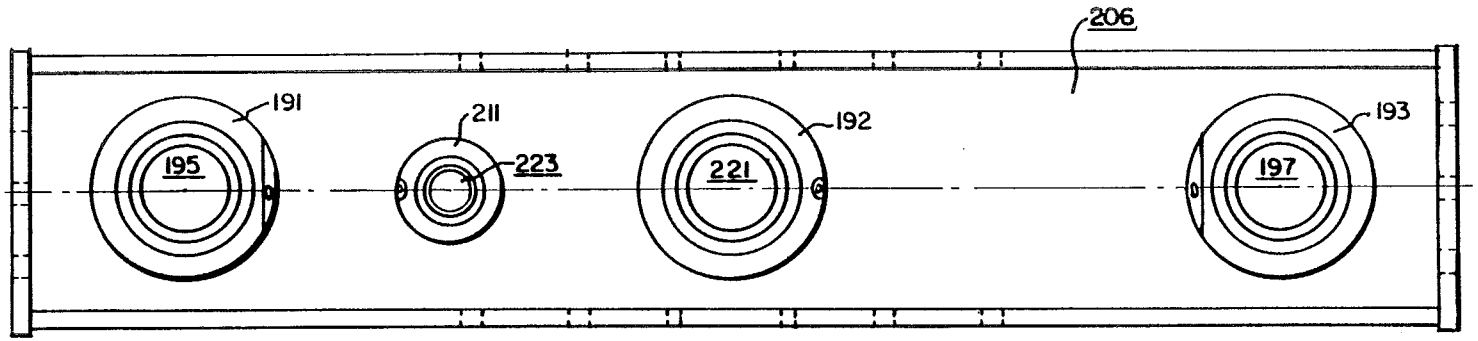
Figure 4E:
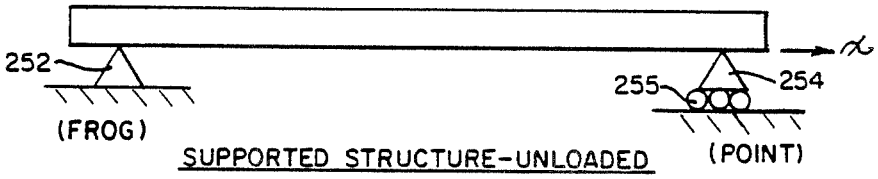
FIGS. 4E and 4F show schematic load diagrams illustrating the operation of the load support arrangement for the switch frame.
Figure 4F:
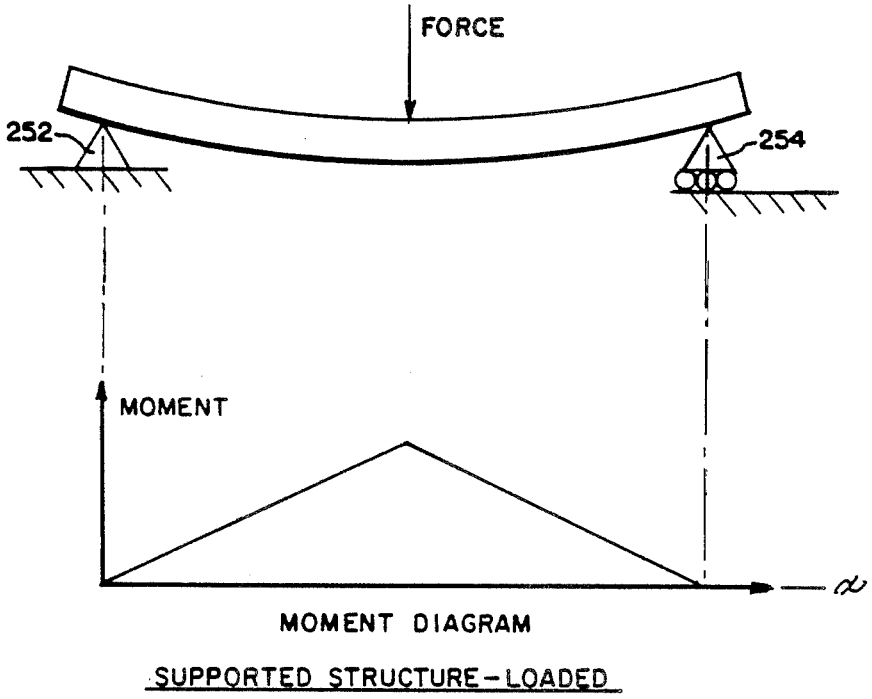

FIGS. 4C and 4D show enlarged views of the frog end cross beam 206 for the guideway switch frame 110. The point end cross beam 208 is the same as the beam 206.

As shown in the elevational view of FIG. 3C, the end beam 206 has respective seats 191 and 193 having openings 195 and 197 for receiving lock pins when the rotary switch frame 110 is rotated into either of its two guideway operation positions. As shown in the plan view having portions broken away (FIG. 4D), lock pin support is provided by a spherical bearing 199 or 201 which is provided with a retaining ring 203 or 205 and a grease fitting 207 or 209.

At a central location of the rotary frame end beam 206, the bearing seat is provided with an opening 221 for receiving the frog end drive shaft 142. The spherical bearing 255 provides shaft support. A retaining ring 215 and a grease fitting 217 are again provided for the bearing 255.

To provide for switch frame rotation, the end beam 206 additionally has a seat 211 with an opening 223 for receiving the radially outward end of the crankarm 263 which is connected to the frog end drive shaft 142. A spherical bearing 225 supports the crankarm 263. Again, a retaining ring 227 and a grease fitting 229 are provided for the bearing 225.

The preferred shaft support arrangement for the switch frame 110 is a type of load support structure referred to as a Simple Supported Beam B13.

The lockpins and rotating shaft are mounted on spherical seats located on a common reference line thereby freeing the framework to rotate about the center line as a hinge line under induced vehicle load. With hinge line rotation, translational forces to the hinge line are always vertical, and moments are distributed along the switch framework while essentially no bending moments are induced on the lockpins and shafts, i.e. the latter are significantly reduced in size compared to fixed end support (such as straight bore as opposed to spherical bearing receptacle). In effect, the switch frame carries vehicle load and transfers minimal bending moments to the supporting shafts and lockpins without frame leveraging that would otherwise cause high stresses on the shafts and lockpins.

The hinge line is designated by the reference character 256F in FIG. 4 at the frog end and is best observed in FIG. 4A. A similar hinge line 256P operates at the point end of the frame, and it is best observed in FIG. 4B.

As a result of the operation of the preferred simple support structure for the switch frame support arrangement, vehicle load forces are transmitted through the frame hinge lines essentially as shear stress on the shafts and the lock pins. Otherwise, bending loads applied over the length of the switch frame would produce high tensile stresses on the shafts and locking pins thereby requiring excessively or impractically sized structures for these supporting elements.

It is also significant that the described spherical bearing support structure provides a self-aligning feature permitting 180° rotation of this switch frame 110 without binding against the shafts due to thermal distortion or due to manufacture to accuracy limitations. This self-alignment occurs since the spherical bearings can rotate relative to the switch frame.

Preferably, the lock pin spherical bearings have extended rings that limit the extent of bearing rotation relative to the switch frame thereby assuring alignment conditions for lock pin insertion, to line up with centerlines of the frame support shafts. The lock pin spherical bearings similarly provide self-alignment since the bearings can rotate relative to the switch frame to permit lock pin alignment with the bearings when the switch is rotated into position for lock pin insertion.

In a particular commercial embodiment, the framework was formed from A36 steel employing both rolled and fabricated structural sections. The framework had a span of 31 feet 3 inches, a depth of 17 inches and a width of 6 feet 7 and ¼ inches. To minimize the cumulative effects of fatigue, all connections except one were secured by high strength bolts. Maximum live load deflection at midspan was ¼ inch.

The assembly of the rotary switch frame 110 with the fixed equipment frames 149 and 153 is shown most clearly in FIG. 4. This Figure highlights assembly detail. FIGS. 4A and 4B show views taken along the indicated reference planes and are further enlarged to provide a better showing of various features of the structural assembly.

Figure 5:
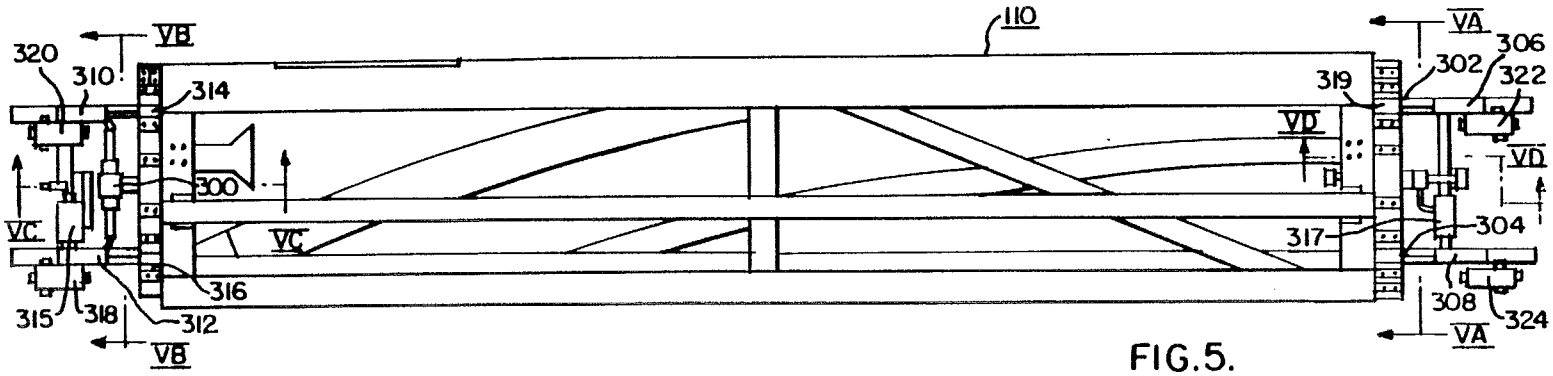
FIG. 5 is a top plan view of the general assembly of the single turnout rotary guideway switch, i.e. the assembly of the movable switch portion with frog and point end equipment frames.

As shown in FIG. 5, the drive shaft 142 is driven by a rotary hydraulic actuator 300 of the piston driven rack and pinion type. In the referenced commercial embodiment, the rotary actuator had a maximum torque of 30,000 in. lbs. with system relief maintained at a pressure of 1200 psi. Maximum working capacity is 75,000 in. lbs. at 3000 psi.

Point end lock pins 302 and 304 are respectively driven by hydraulic actuators 306 and 308. Similarly, frog end hydraulic actuators 310 and 312 respectively drive point end lock pins 314 and 316. The actuators have built-in cushions for end-of-stroke deceleration.

Figure 5D:
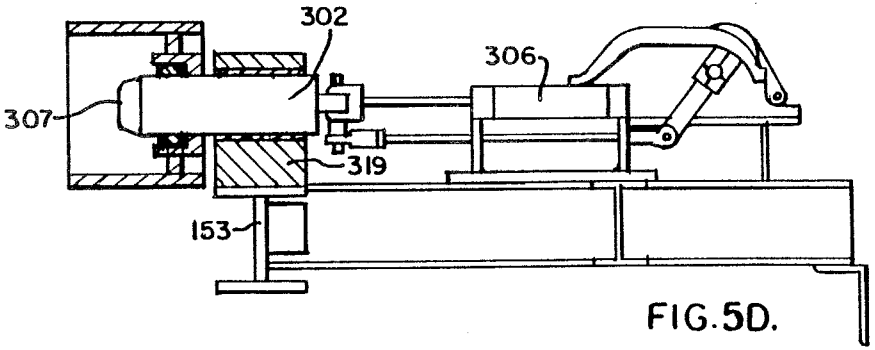
FIGS. 5A through 5E show various enlarged views taken along the indicated reference planes in FIG. 4 to illustrate the rotational support shaft and lockpin operating systems.
Figure 5E:
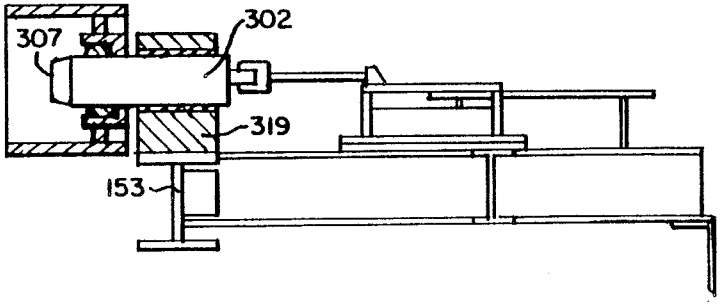
Figure 5A:
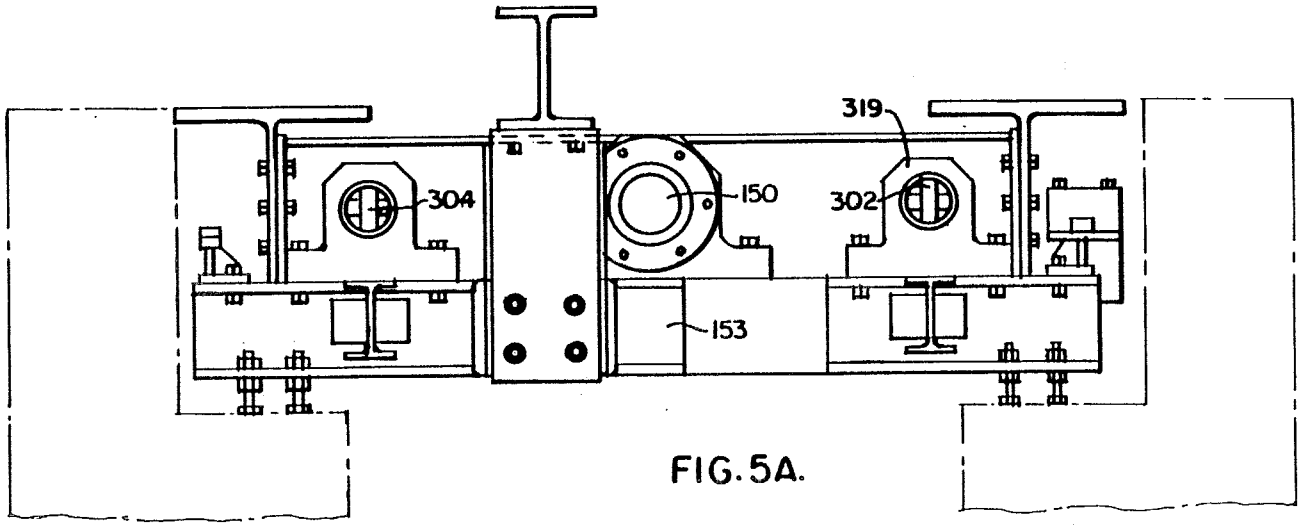

FIG. 5A shows the fixed equipment frame 153 from the point end and toward the rotary switch frame. Accordingly, the spatial relationship of the passive shaft 150 and the lockpins 304 and 302 is clearly illustrated.

Figure 5C:
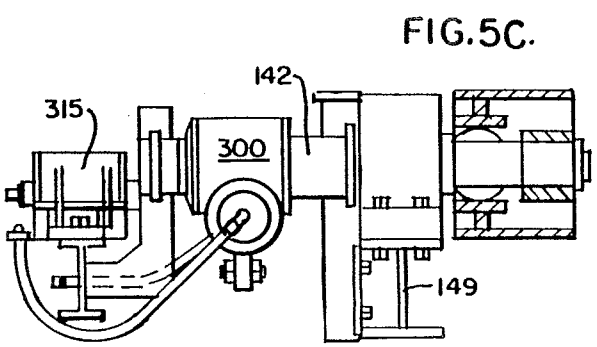
Figure 5B:
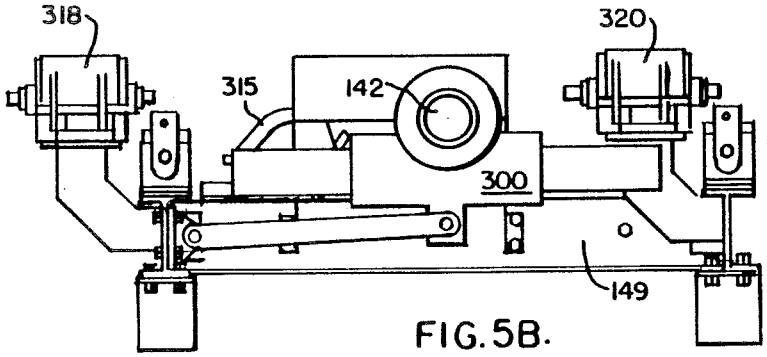

FIG. 5B is an enlarged view that shows the frog end lockpin and rotary shaft actuators in elevation from the frog end of the rotary switch frame. FIG. 5C is an enlarged view showing the relationship of the rotary actuator 300 to the drive shaft 142.

FIG. 5D is an enlarged view that shows the lockpin system with the lockpin 302 in the locked position. When the lockpin is moved to its unlocked position by the actuator 306, pin end face 307 is moved rightward so that it is located within bearing block 319 which is supported by the fixed frame 153. FIG. 5E is similar to FIG. 5D except that it pertains to an inactive switch, i.e. a switch that is installed to provide guideway operation in one lane with the expectation that the switch will be usable at a later date when another lane to which it is to be connected becomes operational. Accordingly, the lockpin is held in a fixed locked position by the structure located to its right in FIG. 5E.

As an additional advantage of the invention, the maintenance requirements are relatively minimal because of the simplicity of design and operation of the rotary switch. Thus, the spherical, sleeve and tapered roller bearings supporting the switch shafts and the lockpins can be selected for high capacity with extended life and minimal maintenance. Readily accessible grease fittings are preferably used to facilitate periodic lubrication. The lockpins, shafts, gear segments, and hardware associated with the lockpin actuating cylinders are preferably made from stainless steel to resist the detrimental effects of corrosion. Further, shafts are preferably oversized to assure product durability.

Respective position sensors (referred to in the trade as controllers) 318, 320, 322, and 324 are provided to generate feedback position signals for the lock pins 314, 316, 302 and 304. Gear driven position sensors 315 and 317 are respectively coupled to the frame shafts 142 and 150 to provide feedback signals that define the rotary frame position.

The hydraulic actuator and sensor equipment items are supported on the respective frog end and point end fixed frames 149 and 153.

Overview-Switch Operation

In the operation of the people mover system, each rotary guideway switch position is specified over the ATO circuit according to the path to be followed by vehicles moving in the system. Switch positions, sensed as previously noted, are checked against specified positions and any required changes are sent as switching commands over the ATO system. Wayside interlocking logic detects any guideway switch that fails to be positioned and locked as commanded and initiates safety car stoppage until the problem is corrected. If necessary, manual switch operation can be executed by operation of the hydraulic unit at the guideway switch location.

At the guideway switch location, a switch position change is implemented by the following actions:

1. The lock pin hydraulic actuators withdraw the switch frame lock pins.
2. The lock pin position sensors verify the withdrawal of the lock pins.
3. The rotary hydraulic actuator turns the drive shaft until the switch frame has moved from its previous position to its new position.
4. The shaft position sensors verify the existence of the new switch frame position.
5. The lock pin hydraulic actuators insert the lock pins into the switch frame.
6. The lock pin position sensors verify the insertion of the lock pins.

Total time for executing a switching operation is typically 10 seconds.

When the rotary guideway switch is in the main lane position, vehicle loading forces the switch frame toward the stop structure in the main lane position. Safe operation thus occurs even if the lock pins have been withdrawn from the switch frame and not reinserted for some reason.

Switch manufacture is significantly economized and switch operation is significantly facilitated by the fact that the switch structural strength and weight can be safely and relatively reduced because:

1. Reduced vehicle loading results from structuring the rotary switch so that only those tires on one side of the vehicle, or the substantial equivalent thereof, can be on the guideway switch as the vehicle moves over the switch in either switch position.
2. Reduced frame, lock pin and shaft strength requirements result from the hinge line, simple support arrangement.

As previously indicated, significant savings in system construction costs and enhancement in system aesthetics are provided by avoidance of any requirement for guideway bulging at crossover switching locations. These advantages essentially result from the "single" tire path configuration of the rotary switch.

From the standpoint of product strength, vertical loads induced in the switch frame are transmitted through the lock pins to the lock pin guide blocks on the equipment frames to the support pillasters. In the referenced commercial embodiment, the weight of the switch frame itself is 16,500 lbs.

Vehicle load is induced on the switch frame through the vehicle tires. In the commercial embodiment, load was specified at 7500 lbs. per tire with an axle spacing of 14.5 feet and with at most three; tires on the rotary switch frame. Maximum lateral loads due to guide tires was 3000 lbs. resulting in 3000 lbs. lateral load and an additional 1000 lbs. vertical load per main axle. To accommodate vehicle braking and acceleration on the switch frame, each equipment support was sized to take in excess of 9600 lbs. longitudinal load. Overall, switch frame stiffness was employed to limit deflection to less than ¼ inch in the tangent switch position and less than ⅛ inch in the turnout position at specified vehicle loading. Differential thermal expansions of concrete, steel, aluminum and rigid plastic also were reflected in the commercial rotary switch design.

From the standpoint of safety, the following summary comments apply:

1. The switch tends by its own weight to rotate into the closest alignment position against structural stops.
2. In the high speed tangent position, the vehicle tires are only on one side of the switch frame to hold the switch against the stops even if the lock pins are unlocked.
3. The lock pins are sized to be structurally redundant, i.e. four levels of switch support in addition to the support from the structural stops.
4. Vehicle wrong entry stops keep the vehicle locked onto the guideway.
5. Continuous power and signal rail through the switch eliminates vehicle speed restrictions often required with the use of guideway switches having mechanical on/off rail ramping.

Lane Crossover Embodiment

In FIG. 6A1, there is shown a top plan view of another embodiment of the invention in which two right hand rotary guideway switches 502 and 504, like the switch 100 (FIG. 2 series) previously described, are reversely positioned and disposed with interface guideway structure 503 so as to form a crossover switch arrangement 500 for vehicle switching between main lanes 506 and 508 that run along side each other. The switches 502 and 504 are shown in their tangent or main lane position. The previously considered FIGS. 2A and 2B show portions of the single rotary switch with less detail.

The crossover switch 500 is incorporated into the system without producing a bulge in the dual lane guideway, i.e. without increasing the centerline to centerline spacing between guideway lanes As subsequently more fully described, the switching structure enables the interlane interface 503 to be sufficiently short that no guideway bulging occurs.

The main lane 506 has vehicle tire paths 510 and 512. Similarly, the main lane 508 has vehicle tire paths 514 and 516. In the illustrated switch tangent positions, the tire path 512 in lane 506 includes switch tire path 512S and the tire path 514 in lane 508 includes switch tire path 514S. The entire outer tire paths 510 and 516 are a part of the fixed guideway structure for the respective lanes 506 and 508.

When the switches 502 and 504 are rotated to their turnout positions like the turnout position shown in FIG. 6A2, the guideway configuration of the turnout side of the rotary switch 502 and the guideway configuration of the rotary switch 504 are aligned with the guideway configuration of the guideway crossover interface structure 503. Lane crossover is thus provided for vehicles moving through the switches.

Specifically, interface tire path IF512-516 connects main lane tire paths 512 and 516 via turnout side tire paths of the switches 502 and 504 (see FIG. 2B) and interface tire path IF510-14 connects main lane tire paths 510 and 514 via the other turnout side tire paths of the switches 502 and 504. Interface guidebeam 518 and interface power and signal rail structure 520 and 522 provide the guidebeam and rail interface between the switches 502 and 504 in their turnout positions so that continuous guidance, power and signalling are maintained as a vehicle undergoes guideway crossover switching.

The rotary guideway switches 502 and 504 are disposed in respective pits 524 and 526 (FIG. 6A3) like the pits described for the single turnout rotary switch in copending application Ser. No. 07/211/723. Each rotary switch is provided with a hydraulic control unit and switch logic cabinet as shown.

Mechanical operation of switches 502 and 504 is identical to the switch 100 described previously herein. However, they are preferably electrically interlocked to work in unison.

The significance of this embodiment of the invention lies in the advantages gained from the application of rotary guideway switches to achieve crossover switching for guideways having guidebeam and electrical rail structure, or portions thereof, above the tire running surfaces and usually between the main vehicle tires. This type of guideway configuration has advantages in economy, efficiency and performance, yet, it has presented problems in achieving guideway switching while maintaining continuous power since, without special accommodating provisions, the main lane path crosses through turnout guidebeam and/or rail structure and any tire turnout path crosses through the main lane guidebeam and/or rail structure. A guidebeam gap problem and/or an electrical gap problem thus has existed for guideway configurations having guidebeam or rail structure above the tire running surfaces and between the vehicle tires.

With pivot type switches in the prior art, the electrical gap problem has been addressed by correlating switch geometry and vehicle length with rail gaps, and using mechanical on/off rail ramping for the collectors with multiple front and rear collector brush assemblies so that one set of collectors always has electric rail contact and electrical continuity is provided during vehicle path switching. However, in addition to its complexity disadvantage, this approach produces bulging of a dual lane guideway at the crossover switch. Bulging is an increase in the spacing between centerlines of the guideway lanes and is highly undesirable from a construction cost standpoint and from an aesthetic point of view. Generally, bulging results from the fact that the guideway interface segment between the crossover switches has to be longer than the spacing between the front and rear vehicle collectors so that both collectors are never simultaneously located at the rail gaps of the two crossover switches i.e. at least one collector always has rail contact.

Thus, for the Westinghouse C-100 vehicle the crossover lane-to-lane spacing for prior art pivot switches must be greater than 21 feet causing a bulge in the normal dual guideway having a lane spacing of 13 feet or less. For the Westinghouse C-45 car, the lane-to-lane spacing is 11 feet and the crossover section is 11 feet, resulting in no bulge or tangent alignment variation along the C-45 guideway.

Prior art transfer tables address the problem by using horizontal table movement to place either a main lane switch path with main lane guide beam and rail structure or a turnout switch path with turnout guide beam and rail structure in the main lane path at the crossover location. The transfer table approach also produces guideway bulging, costly construction and operating inefficiencies. Drastic bulge results from the space needed for storage of the unused guideway switch path. Such storage space has to be located either between or outside the guideway lanes and normally, both.

More beneficially, the present invention employs switch rotation to provide crossover switching without guideway bulging and with construction economy, operating efficiency and improved smoothness of ride. Thus, interface paths IF512-16 and IF510-14 only have a length needed to bridge over the normal spacing between the lanes and no guideway bulging occurs. Further, no bulging results from storage of the unused guideway switch path since storage is provided in effect in a pit inside the guideway main lane as opposed to being provided beside the guideway main lane.

Figure 6B:
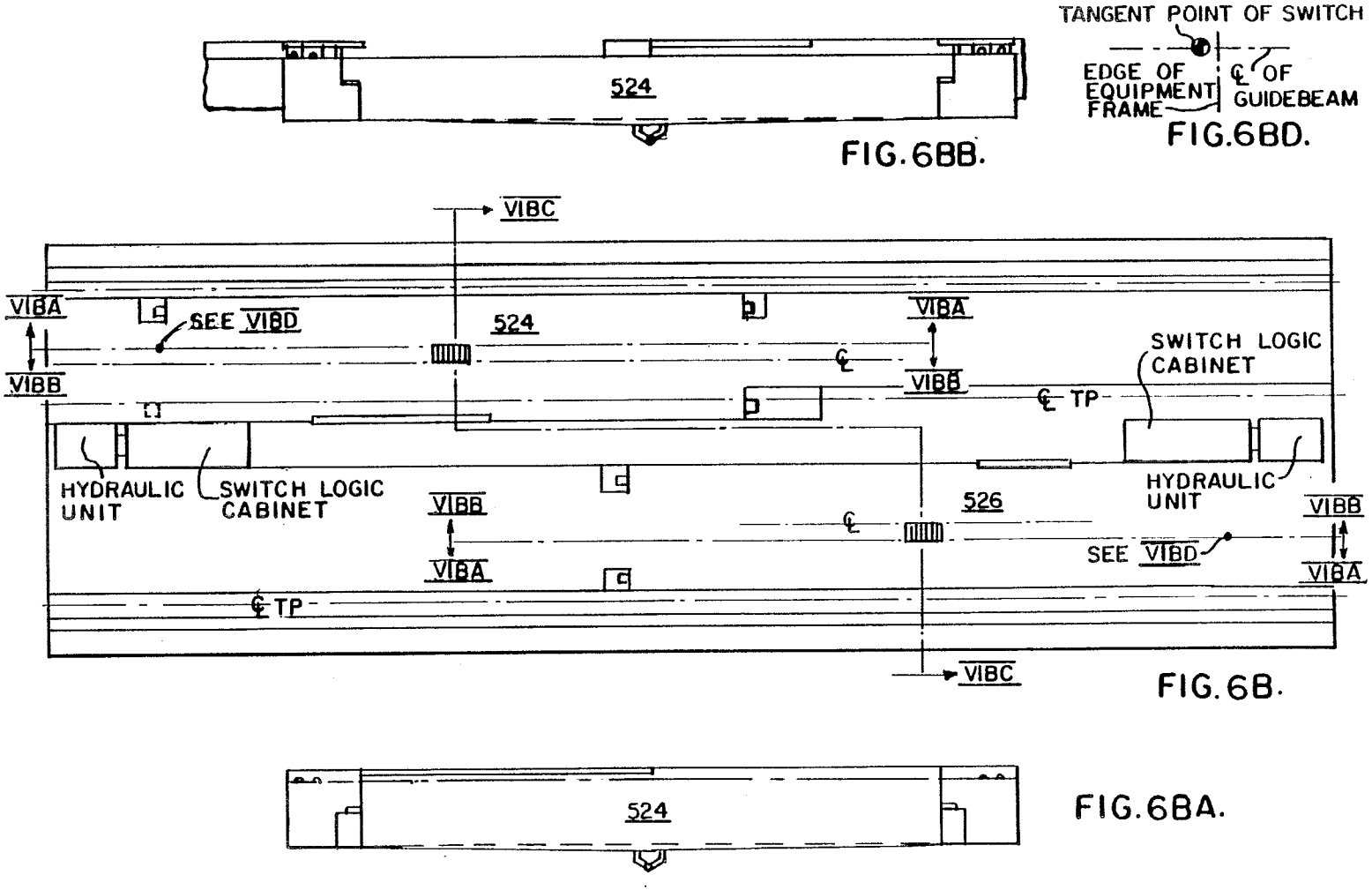
FIGS. 6B and 6BA-6BD, provide various views of a switch pit employed in the crossover switch embodiment.
Figure 6B:
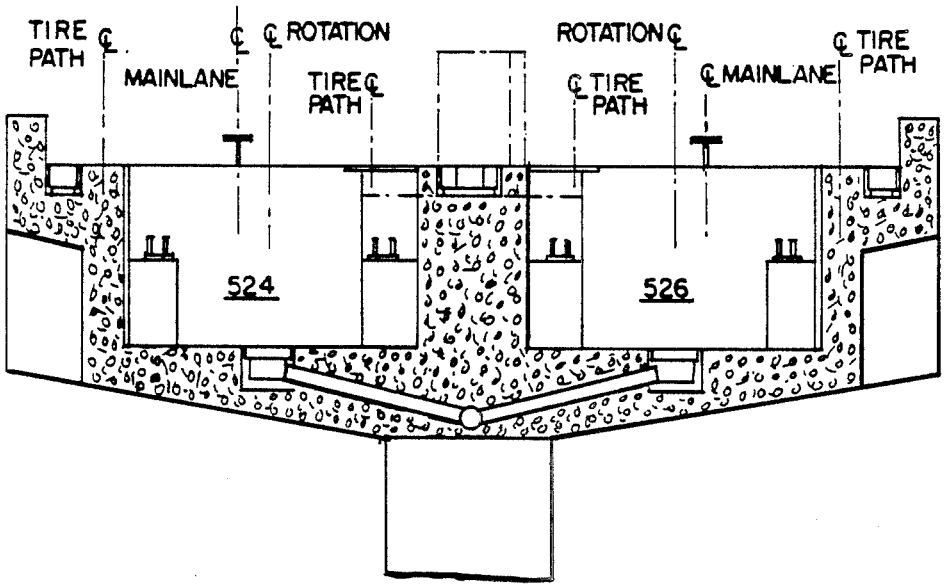

FIG. 6B shows the equipment pits for the crossover rotary switches 502 and 504 in greater detail. It shows a view of the pit from the top with all equipment removed. Various features of the pit are highlighted by the illustrated views as follows:

FIG. 6BA - elevation view of the tangent wall.

FIG. 6BB - elevation view of turnout wall with main and equipment pit wall structure.

FIG. 6BC - a typical cross-section of an elevated concrete superstructure for a crossover switch arrangement; the cross-section is stepped to show the respective longitudinally displaced pits for the two lanes from their approximate longitudinal midpoints; cable tray integration is highlighted for the crossover structure.

FIG. 6BD - shows point of tangency of the 75 foot radius curve from the main guideway lane; this is the reference workpoint for all of the switch plan geometry.

Other details of crossover switch pits 524 and 526 are identical to the single turnout pit described in copending application Ser. No. 07/211,723.

What is claimed is:

1. A single turnout rotary switch for a people mover guideway including a fixed guideway configuration having a predetermined tire path, guidebeam and electric rail configuration, said rotary switch providing for routing a transit car having load bearing tires from a main lane entry guideway path to a main lane exit guideway path or a turnout guideway exit path and comprising:

an elongated structural switch frame member provided with guidebeam, electric rail and tire path configuration structure on one side compatible with the guideway configuration to provide transit car routing to said main lane exit path; said switch frame member further provided with guidebeam, electric rail and tire path configuration structure on another side compatible with the guideway configuration to provide transit car routing to said turnout exit path;

first support means having first shaft means for rotatably supporting one end of said switch frame member;

second support means having second shaft means for rotatably supporting the other end of said switch frame member;

drive means for driving at least one of said shaft means to rotate said switch frame member between first and second frame positions;

said switch frame member having its one side aligned with the entry guideway path and the one exit guideway path in said first frame position and having its other side aligned with the entry guideway path and the other exit guideway path in said second frame position; and means for locking said switch frame member against rotation from said first or second frame position.

2. A single turnout rotary guideway switch as set forth in claim 1 wherein said switch frame member includes: a pair of laterally spaced, elongated, and generally straight beam means operating as principal structural members for said switch frame member; at least one curved beam means extending in the lateral and longitudinal directions between said elongated beam means to provide cross-support for said switch frame member, at least one of said elongated beam means having an elongated surface facing outwardly to said one side of said switch frame member to provide for one main lane tire path over the switch for the car tires on one side of the transit car, and said curved beam means having a curved surface facing outwardly to the other side of said switch frame member to provide one switch turnout tire path for the car tires on one side of the transit car.

3. A single turnout rotary guideway switch as set forth in claim 2 wherein said switch frame member includes: a first end beam means extending laterally between and secured to said elongated beam means at one end thereof; and a second end beam means extending laterally between and secured to said elongated beam means at the other end thereof, said first and second end beams means respectively supported by said first and second support means.

4. A single turnout rotary guideway switch as set forth in claim 3 wherein said switch frame member includes another beam means extending laterally and longitudinally between said elongated beam means to provide additional cross-support for said switch frame member.

5. A single turnout rotary guideway switch as set forth in claim 3 wherein said first support means includes first supporting means for supporting said switch frame member in fixed longitudinal relationship to said first shaft means at one end of said switch frame member, and said second means includes second supporting means for supporting said switch frame member in longitudinally expandable relation to said second shaft means at the other end of said switch frame member.

6. A single turnout rotary guideway switch as set forth in claim 5 wherein said first and said second supporting means and said locking means support said switch frame member for pivotal deflection about respective transverse hinge lines at each end of the switch frame member, which hinge lines extend through said supporting means and locking means at each end of said switch frame member.

7. A single turnout rotary guideway switch as set forth in claim 2 wherein said one elongated beam means provides the only main lane tire path over the one side of said switch frame member and further including means comprising a part of the fixed guideway structure providing a second main lane tire path, said second main lane tire path being spaced from said one main lane tire path when said switch frame member is in said first frame position to operate as a main lane path for the transit car tires on the other side of the car.

8. A single turnout rotary guideway switch as set forth in claim 7 wherein the other of said elongated beam means has a surface facing outwardly to the other side of said switch frame member to provide another switch turnout tire path spaced from said one turnout switch path for the tires on the other car side when said switch frame member is in said second frame position, said other switch turnout path being substantially shorter than said one switch turnout path.

9. A single turnout rotary guideway switch as set forth in claim 8 wherein the width of said switch frame member is such that the lengths of said one and said other turnout switch paths are approximately equivalent to the length of the car turnout path from its point of entry to said switch frame member to its point of exit from said switch frame member.

10. A single turnout rotary guideway switch as set forth in claim 3, and further including; elongated switch guidebeam means and elongated switch electric rail means supported on said one side of said switch frame member above said one main lane tire path and between said one switch main lane tire path and said second main lane tire path when said switch frame member is in said first frame position; and curved switch guidebeam means and curved switch electric rail means supported on the other side of said switch frame member above and between said one switch turnout tire path and the other switch turnout tire path when said switch is in said second frame position.

11. A single turnout rotary guideway switch as set forth in claim 2 wherein said outwardly facing surface of said one elongated beam means forms a switch main lane tire path, said outwardly facing surface of said curved beam means forms said one switch turnout tire path, said other elongated beam means has a surface facing outwardly to the other side of said switch frame member forming another switch turnout tire path spaced from said one switch turnout path for the tires on the other side of the car when said switch frame member is in said second frame position.

12. A single turnout rotary guideway switch as set forth in claim 2 wherein said first support means includes first supporting means for supporting said frame in fixed longitudinal relationship to said first shaft means at one end of said switch frame member, and said second support means includes second supporting means for supporting said switch frame member in longitudinally expandable relation to said second shaft means at the other end of said switch frame member.

13. A single turnout rotary guideway switch as set forth in claim 12 wherein said first and said second supporting means and said locking means are arranged to support said frame for pivotal deflection about respective transverse hinge lines at each end of said switch frame member, which hinge lines, respectively, extend through said supporting means and said locking means at each end of said switch frame member.

14. A single turnout rotary guideway switch as set forth in claim 1, wherein said drive means rotates said switch frame member about an axis that is parallel to the center line of the main line path of the fixed guideway configuration.

15. A guideway crossover switching station for a dual lane people mover guideway including a fixed guideway configuration having a predetermined tire path, guidebeam and electric rail configuration, said crossover switching station providing for routing a transit car having load bearing tires from an entry guideway path in either lane to an exit guideway path in the same lane or an exit guideway path in the other lane and comprising:

a dual lane, crossover guideway section structured at its entry and exit points to provide a predetermined guideway configuration including a pair of spaced tire paths for cars operating in the people mover system;

a first elongated single turnout rotary switch frame member assembled with said crossover guideway section in a first lane of the dual lane guideway and provided with guidebeam, electric rail and tire path structure on one side compatible with the guideway configuration to provide car routing from the entry path to the exit path in the same lane; said switch frame member further provided with guidebeam, electric rail and tire path structure on another side compatible with the guideway configuration to provide car crossover routing between the lanes;

a second elongated single turnout rotary switch frame member assembled with said crossover guideway section in the other lane of the dual lane guideway and provided with guidebeam; electric rail and tire path structure on one side compatible with the guideway configuration to provide car routing from the entry path to the exit path in said other lane; said second switch frame member further provided with guidebeam, electric rail and tire path structure on another side compatible with the guideway configuration to provide car crossover routing between the lanes;

first and second support means including respective first and second shaft means for rotatively supporting opposite ends of each of said switch frame members;

drive means for driving at least one of the shaft means of each switch frame member to rotate each of said switch frames between first and second frame positions;

each of said switch frame members having its one side aligned with the entry and exit guideway paths in its lane in said first frame position and having its other side aligned with the entry or exit guideway path in its lane and a crossover path to the other switch frame member in said second frame position;

crossover guideway means provided with said guideway configuration and interfacing said first and second switch frame members in their second frame position to provide said crossover path for car crossover between lanes when said switch frame members are in their second frame position; and means for locking each of said switch frame members against rotation from said first or second position.

16. A guideway crossover switching station as set forth in claim 15 wherein each of said switch frame members includes: a pair of laterally spaced, elongated, and generally straight beam means operating as principal structural members for said switch frame member; and at least one curved beam means extending in the lateral and longitudinal directions between said elongated beam means to provide cross-support for said switch frame member, at least one of said elongated beam means having an elongated surface facing outwardly to said one side of switch frame member to provide for one main lane tire path over the switch for the car tires on one side of the car, and said curved beam means having a curved surface facing outwardly to the other side of said switch frame member to provide for one switch turnout tire path for the car tires on one side of the car.

17. A guideway crossover switching station as set forth in claim 16 wherein each said one elongated beam means provides the only main lane tire path over said one side of the respective switch frame member and further including means comprising a part of the fixed guideway structure providing a second main lane tire path in each lane, each said second main lane tire path being spaced from an associated one of the main lane tire paths on the respective switch frame member when the respective switch frame member is in its first position to operate as a main lane path for the car tires on the other side of the transit car.

18. A guideway crossover switching station as set forth in claim 17 wherein the other of said elongated beam means of each said switch frame member has a surface facing outwardly to other side of said switch frame member to provide another switch turnout tire path spaced from said one turnout switch path for the tires on the other car side when said switch frame member is in said second frame position.

19. A guideway crossover switching station as set forth in claim 18, and further including: elongated switch guidebeam means and elongated switch electric rail means supported on each said one side of a respective one of said switch frame members above said one main lane tire path and between said one main lane tire path and said second main lane tire path when the respective switch frame member is in said one position; and curved switch guidebeam means and curved switch electric rail means supported on each said other side of a respective one of said switch frame members above and between said one switch turnout tire path and the other turnout tire path when the respective switch frame member is in said second frame position.

20. A guideway crossover switching station as set forth in claim 15 wherein said guideway section includes first wall means forming a switch pit located under said first switch frame member and second wall means forming a switch pit located under said second switch frame member, each of said switch pits providing space for rotation of its respective switch frame member between the two frame positions thereby providing for vertically displaced storage of inactive guidebeam, electrical and tire path structure in each of the two frame positions.

21. A guideway crossover switching station as set forth in claim 20 wherein said support means includes fixed equipment frame means for supporting each end of each switch frame member, and means for supporting said fixed equipment frame means at opposite ends of each of said switch pits.

22. A guideway crossover switching station as set forth in claim 15, wherein said drive means rotates each said switch frame member about the center line of the respective lane of the dual lane guideway.

* * * * *